US008881843B2

(12) United States Patent
Todd et al.

(10) Patent No.: US 8,881,843 B2
(45) Date of Patent: Nov. 11, 2014

(54) MANAGED PRESSURE AND/OR TEMPERATURE DRILLING SYSTEM AND METHOD

(75) Inventors: Richard J. Todd, Houston, TX (US); Don M. Hannegan, Fort Smith, AR (US); Simon J. Harrall, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 1324 days.

(21) Appl. No.: 12/278,692

(22) PCT Filed: Feb. 9, 2007

(86) PCT No.: PCT/US2007/061929

§ 371 (c)(1),
(2), (4) Date: May 21, 2009

(87) PCT Pub. No.: WO2007/092956

PCT Pub. Date: Aug. 16, 2007

(65) Prior Publication Data

US 2009/0236144 A1 Sep. 24, 2009

Related U.S. Application Data

(60) Provisional application No. 60/771,625, filed on Feb. 9, 2006.

(51) Int. Cl.
*E21B 7/00* (2006.01)
*E21B 7/06* (2006.01)

(Continued)

(52) U.S. Cl.
CPC ..... *E21B 47/065* (2013.01); *E21B 17/01* (2013.01); *E21B 2021/006* (2013.01);

(Continued)

(58) Field of Classification Search
USPC ..... 166/358, 302, 369, 366, 267, 52, 356, 166/272.1, 60; 175/5, 65, 61, 40, 117, 206, 175/207
See application file for complete search history.

(56) References Cited

U.S. PATENT DOCUMENTS 3,273,660 A 9/1966 Jackson et al.
3,559,737 A 2/1971 Ralstin et al.

(Continued)

FOREIGN PATENT DOCUMENTS

CN 101787867 A 7/2010
WO WO 2007/061816 5/2007

OTHER PUBLICATIONS

Canadian Office Action for Application No. 2,641,596 dated Dec. 17, 2009.
GB Examination and Search Report for Application No. GB0814509.6 dated Feb. 2, 2011.
Hannegan et al.—"MPD—Uniquely Applicable to Methane Hydrate Drilling", paper prepared for presentation at the 2004 SPE/IADC Underbalanced Technology Conference and Exhibition held in Houston, Texas, Oct. 11-12, 2004, SPE/IADC 91560, pp. 1-4.

(Continued)

*Primary Examiner* — James Sayre
(74) *Attorney, Agent, or Firm* — Patterson & Sheridan, L.L.P.

(57) ABSTRACT

The present invention relates to a managed pressure and/or temperature drilling system (300) and method. In one embodiment, a method for drilling a wellbore into a gas hydrates formation is disclosed. The method includes drilling the wellbore into the gas hydrates formation; returning gas hydrates cuttings to a surface of the wellbore and/or a drilling rig while controlling a temperature and/or a pressure of the cuttings to prevent or control disassociation of the hydrates cuttings.

36 Claims, 25 Drawing Sheets

(51) Int. Cl.

| | |
|---|---|
| ***E21B 23/00*** | (2006.01) |
| ***E21B 47/06*** | (2012.01) |
| ***E21B 47/00*** | (2012.01) |
| ***E21B 29/06*** | (2006.01) |
| ***E21B 43/11*** | (2006.01) |
| ***E21B 33/12*** | (2006.01) |
| ***E21B 7/12*** | (2006.01) |
| ***E21B 17/01*** | (2006.01) |
| ***E21B 21/06*** | (2006.01) |
| ***E21B 43/10*** | (2006.01) |
| ***E21B 21/08*** | (2006.01) |
| ***E21B 21/10*** | (2006.01) |
| ***E21B 19/00*** | (2006.01) |
| ***E21B 33/035*** | (2006.01) |
| ***E21B 21/01*** | (2006.01) |
| ***E21B 47/12*** | (2012.01) |
| ***E21B 36/00*** | (2006.01) |
| ***E21B 21/12*** | (2006.01) |
| *E21B 21/00* | (2006.01) |
| *E21B 43/01* | (2006.01) |

(52) U.S. Cl.

CPC ..... *E21B 21/067* (2013.01); *E21B 43/103* (2013.01); *E21B 21/08* (2013.01); *E21B 21/10* (2013.01); *E21B 19/002* (2013.01); *E21B 47/06* (2013.01); *E21B 21/063* (2013.01); *E21B 33/0355* (2013.01); *E21B 21/01* (2013.01); *E21B 21/065* (2013.01); *E21B 33/035* (2013.01); *E21B 47/123* (2013.01); *E21B 36/003* (2013.01); *E21B 36/00* (2013.01); *E21B 36/001* (2013.01); *E21B 47/122* (2013.01); *E21B 2043/0115* (2013.01); *E21B 21/12* (2013.01); *E21B 47/12* (2013.01)

USPC ..... 175/5; 175/65; 175/40; 175/17; 166/358; 166/302; 166/369; 166/267; 166/356; 166/272.1

(56) References Cited

U.S. PATENT DOCUMENTS

| | | | | |
|---|---|---|---|---|
| 3,638,721 | A | | 2/1972 | Harrison |
| 3,881,755 | A | | 5/1975 | Brunato |
| 4,067,596 | A | | 1/1978 | Kellner et al. |
| 4,371,045 | A | | 2/1983 | McGuire et al. |
| 4,422,513 | A | * | 12/1983 | Franklin ..... 175/17 |
| 4,626,135 | A | | 12/1986 | Roche |
| 5,423,575 | A | | 6/1995 | Parks |
| 6,197,095 | B1 | | 3/2001 | Ditria et al. |
| 6,216,799 | B1 | | 4/2001 | Gonzalez |
| 6,415,877 | B1 | * | 7/2002 | Fincher et al. ..... 175/5 |
| 6,807,854 | B2 | | 10/2004 | Peysson et al. |
| 6,932,161 | B2 | | 8/2005 | Cameron |
| 7,048,063 | B2 | | 5/2006 | Cameron |
| 7,165,621 | B2 | * | 1/2007 | Ayoub et al. ..... 166/369 |
| 7,546,880 | B2 | * | 6/2009 | Zhang et al. ..... 166/358 |
| 2004/0007131 | A1 | | 1/2004 | Chitty et al. |
| 2004/0159435 | A1 | | 8/2004 | Plucheck et al. |
| 2004/0198611 | A1 | | 10/2004 | Atkinson |
| 2005/0284504 | A1 | | 12/2005 | Kinnari et al. |
| 2008/0060846 | A1 | | 3/2008 | Belcher et al. |

OTHER PUBLICATIONS

Lyons et al.—Excerpt from Standard Handbook of Petroleum & Natural Gas Engineering, Second Edition, published by Gulf Professional Publishing, an imprint of Elsevier Inc., Copyright 2005, pp. 6-280-6-301.

Todd et al.—"Managed Pressure Drilling Tools for Methane Hydrates Production", prepared for presentation at the Offshore Technology Conference 2006, Houston, Texas, May 3, 2006, 22 pages.

Todd et al.—"New Technology Needs for Methane Hydrates Production", paper prepared for presentation at the 2006 Offshore Technology Conference held in Houston, Texas, May 1-4, 2006, OTC Paper No. 18247-PP, pp. 1-9.

International Search Report for International Patent Application No. PCT/US2007/061929, dated Jun. 14, 2007.

GB Search Report for Application No. GB0814509.6 dated Aug. 5, 2010.

Canadian Office Action dated Aug. 29, 2012, Canadian Patent Application No. 2,734,546.

International Preliminary Report on Patentability for application No. PCT/US2007/061929 dated May 18, 2012.

* cited by examiner

FIG. 11B
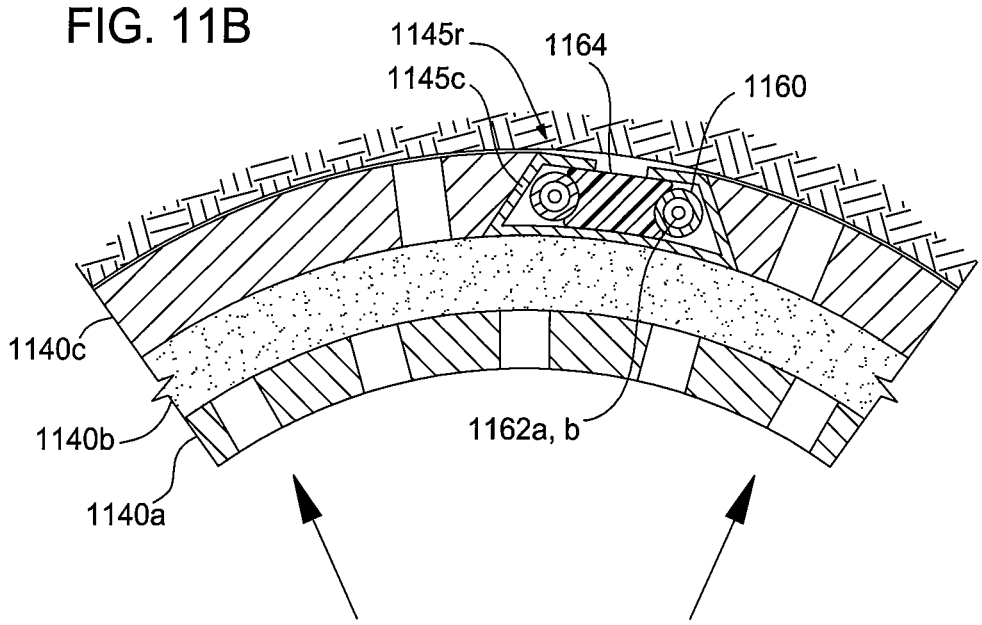
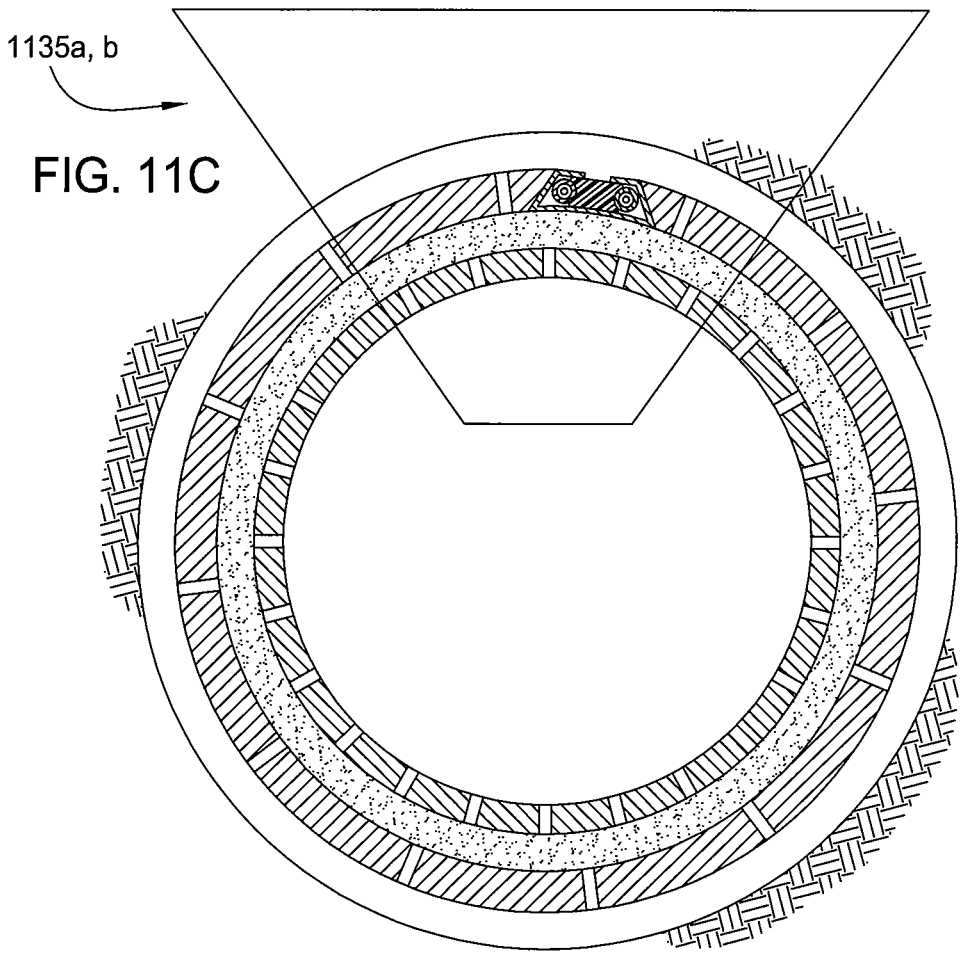
FIG. 11C

MANAGED PRESSURE AND/OR TEMPERATURE DRILLING SYSTEM AND METHOD

This application is a national stage of International Application No. PCT/US2007/061929, filed Feb. 9, 2007, which claims priority to the U.S. Provisional No. 60/771,625, filed Feb. 9, 2006.

BACKGROUND OF THE INVENTION

1. Field of the Invention

The present invention relates to a managed pressure and/or temperature drilling system and method.

2. Description of the Related Art

Natural gas hydrates are individual molecules of natural gas, such as methane, ethane, propane, or isobutene, that are entrapped in a cage structure composed of ice molecules. The hydrates are solid crystals with an "ice like" appearance. Gas hydrates exist in environments that are either high pressure or low temperature or both and have been found in subsea ocean floor deposits and in subsurface reservoirs both on and offshore. The amount of "in place" gas hydrates in the U.S is estimated at 2,000 trillion cubic feet which is equivalent to the produced or known natural gas deposits. For a more in depth analysis of the vast potential of gas hydrates, see SPE/IADC 91560 entitled "MPD—Uniquely Applicable to Methane Hydrate Drilling" by Don Hannegan, et. al (2004).

FIG. 1 illustrates simplified disassociation boundaries for various gas hydrates. The curves may vary depending on the amount of gas trapped in an amount of hydrate. To the left of the curves, formed gas hydrates are in a solid phase. To the right of the curves, the hydrates will disassociate into gas (and water and/or ice). Note also, that a disassociation curve and a formation curve (not shown) for a particular gas hydrate are not the same. A drop in pressure or an increase in temperature will weaken the lattice of ice molecules encasing the gas molecules and allow the gas to liberate freely or disassociate and sublimate to gaseous state. Gas hydrates are a unique product because they may expand over one hundred times from their solid to gas form. This sublimation process can happen in the reservoir, the well bore, or on the surface.

Gas hydrates are an unstable resource due to their expansion characteristics when produced from a reservoir. Gas hydrate deposits have traditionally been treated only as a drilling hazard located in between the surface and a well's prime reservoir target deeper down. In addition, conventional drilling lacks the capacity to manage large quantities of a product that expands hundreds of times as it sublimates. This is unique to gas hydrates and an important issue for drilling and production.

Therefore, there exists a need in the art for a drilling system and method that is capable of drilling through long sections of a hydrates formation without substantially damaging the formation while controlling and handling disassociation of commercial quantities of gas hydrates.

SUMMARY OF THE INVENTION

The present invention relates to a managed pressure and/or temperature drilling system and method. In one embodiment, a method for drilling a wellbore into a gas hydrates formation is disclosed. The method includes drilling the wellbore into the gas hydrates formation; returning gas hydrates cuttings to a surface of the wellbore and/or a drilling rig while controlling a temperature and/or a pressure of the cuttings to prevent or control disassociation of the hydrates cuttings.

In another embodiment, a method for drilling a wellbore into a crude oil and/or natural gas formation is disclosed. The method includes drilling the wellbore into the crude oil and/or natural gas formation with a drill string; and controlling the temperature and pressure of at least a portion of an annulus formed between the drill string and the wellbore while drilling.

In another embodiment, a method for drilling a wellbore into a coal bed methane formation is disclosed. The method includes drilling the wellbore into the coal bed methane formation with a drill string; and controlling the temperature and pressure of at least a portion of an annulus formed between the drill string and the wellbore while drilling.

In another embodiment, a method for drilling a wellbore into a tar sands or heavy crude oil formation is disclosed. The method includes drilling the wellbore into a tar sands or heavy crude oil formation with a drill string; and controlling the temperature and pressure of at least a portion of an annulus formed between the drill string and the wellbore while drilling.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 11A-D illustrate a multi-lateral completion system, according to another embodiment of the present invention. FIG. 11A illustrates a first lateral wellbore of the completion system 1100. FIG. 11C illustrates a sectional view of the expandable liner of FIG. 11A in an unexpanded state. FIG. 11B illustrates a sectional view of a portion of FIG. 11C, in an expanded state. FIG. 11D illustrates the completion system 1100 having a second lateral wellbore formed therein.

DETAILED DESCRIPTION OF THE PREFERRED EMBODIMENT

Figure 1:
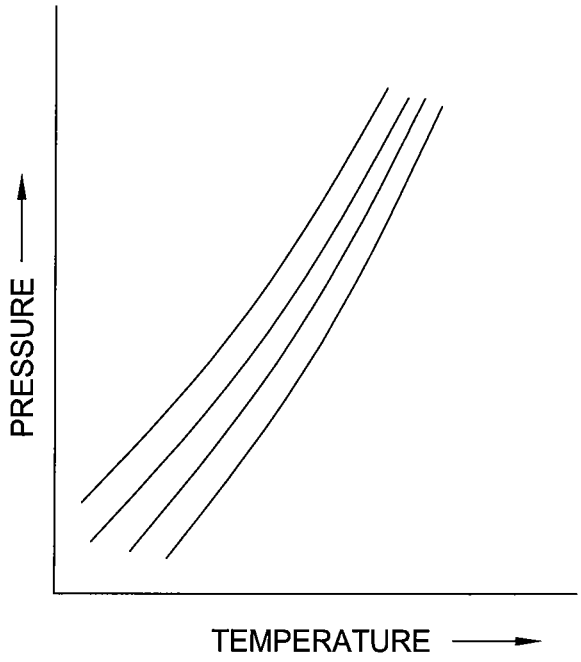
FIG. 1 (PRIOR ART)
FIG. 1 illustrates simplified disassociation boundaries for various gas hydrates.
Figure 2A:
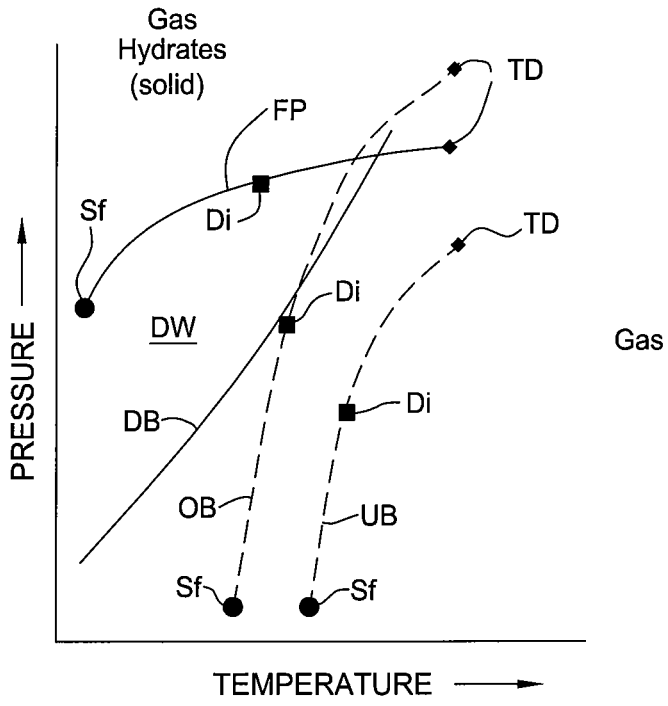
FIG. 2A is a simplified disassociation curve for gas hydrates and illustrates the relationship between the disassociation curve and overbalanced and underbalanced drilling methods.

FIG. 2A is a simplified disassociation curve for gas hydrates and illustrates the relationship between the disassociation curve and overbalanced and underbalanced drilling methods. A disassociation boundary line DB divides the FIG. into two phase regions. To the left of the disassociation boundary DB is the region where the gas hydrates are in a solid form. To the right of the disassociation boundary DB is the region where the gas hydrates will disassociate and produce gas gas. Dynamic annulus profiles UB, OB represent pressure and temperature of points at various depths in annuli of respective wellbores being drilled with underbalanced UB and overbalanced OB methods. Three depths are provided for reference: a first depth near a surface Sf of the wellbore, a third depth near the total depth TD of the wellbore, and an intermediate second depth Di between the first and third depths. A fracture curve FP for the formations at the various depths is also illustrated in FIG. 2A.

In conventional overbalanced drilling operations through gas hydrate deposits, the hydrostatic fluid column significantly overbalances the formations being drilled. Although this generally achieves the objective of penetrating the deposits as safely as possible, this risks invasive mud and cuttings damage to the near wellbore and may render the gas hydrate pay zone to be unproduceable. Additionally, if the high overbalance causes rapid mud losses to other open formations, the resulting reduction in the hydrostatic head of the mud column may trigger dissociation in the near wellbore region, leading to influx into the wellbore and a well control incident.

Underbalanced drilling by nature invites an influx from the reservoir into the well bore, which is then eventually carried to the surface. Inviting an influx from a gas hydrate deposit while drilling risks losing control of the dissociation process, and may also affect wellbore stability. In underbalanced drilling the pressure is not controlled throughout the process or production at least to the point of stabilizing, bringing product to surface, and transferring to production equipment. In a typical underbalanced drilling process, the amount of back pressure on the reservoir is limited.

Using either conventional (overbalanced) or underbalanced drilling to gas hydrate zones will at some point lead to dissociation of hydrates at a location within the wellbore while the cuttings are being transported to surface. Drilling extensive wellbores for production purposes, therefore, exposes the operator to this phenomenon for prolonged periods, and the need for immediate and rapid remedial well control must be continually anticipated.

Figure 2B:
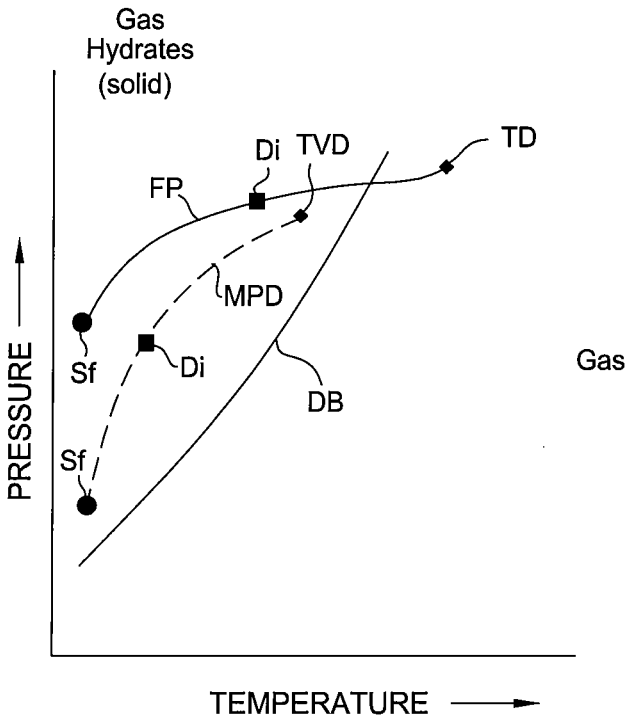
FIG. 2B is the simplified disassociation curve for the gas hydrates of FIG. 2A illustrating the relationship between the disassociation boundary and a managed pressure and/or temperature MPD drilling method, according to one embodiment of the present invention.

FIG. 2B is the simplified disassociation curve for the gas hydrates of FIG. 2A illustrating the relationship between the disassociation boundary and a managed pressure and/or temperature MPD drilling method, according to one embodiment of the present invention.

In drilling a conventional wellbore for crude oil production, it is optimal to maintain the bottom hole pressure (BHP) between the pore pressure and the fracture pressure of the reservoir. In contrast, when drilling a gas hydrates formation, it is optimal to prevent fracturing of the formation and to maintain the annulus so that the gas hydrates will either remain in a solid form both at bottom hole depth and throughout the annulus to the surface or disassociate in a controlled manner as the hydrates travel to the surface in the annulus. Annulus conditions that will maintain the hydrates in a solid from TD to the surface are illustrated by the drilling window DW. As FIG. 2B illustrates, increasing the pressure can mitigate an increase in temperature until the pressure exceeds the fracture pressure of the formation. In addition, the fracture pressure is not only pressure dependent, but also temperature dependent. Therefore, for some gas hydrates formations, the annulus pressure and temperature profile will need to be controlled. For other formations, it may be sufficient to control just the annulus temperature or pressure profile. An alternative approach would instead allow sub-surface disassociation at a predetermined location, i.e. a separator, which is capable of controlling disassociation.

Managed Pressure Drilling (MPD) is an adaptive drilling process used to control the annulus pressure profile throughout the well bore. The objectives are to ascertain the downhole pressure environment limits and to manage the annulus hydraulic pressure profile accordingly. MPD may include control of backpressure, fluid density, fluid rheology, annulus fluid level, circulating friction, and hole geometry, or combinations thereof. MPD allows faster corrective action to deal with observed pressure variations. The ability to dynamically control annulus pressures facilitates drilling of what might otherwise be economically unattainable prospects. MPD techniques may be used to avoid formation influx. Any flow incidental to the operation will be safely contained using an appropriate process. Unlike underbalanced drilling, MPD does not invite an influx from the reservoir into the wellbore.

As discussed above, annulus pressure control aids control over the dissociation of the gas hydrates and prevents damage to the reservoir. Referring again to FIG. 2B, annulus pressure control allows balancing between the fracture pressure of the hydrate formation and the dissociation pressure of the hydrate, while also managing the temperature to also prevent dissociation, and therefore control of the gas hydrates drilling process. Further, managing the well bore pressure may also indirectly manage the temperature and the overall phase state of the Gas Hydrates.

As discussed above, if conditions in the annulus exceed the disassociation boundary DB, then disassociation will occur. However, the rate of disassociation may still be controlled by possessing data indicative of disassociation rates according to various annulus conditions and maintaining wellbore conditions so that the disassociation rate remains manageable. Therefore, instead of maintaining the annulus conditions strictly within the drilling window DW or providing a subsea separator, the disassociation boundary DB may be exceeded by a predetermined amount as long as the capabilities exist to return annulus conditions within the drilling window DW should disassociation become unstable.

Figure 3:
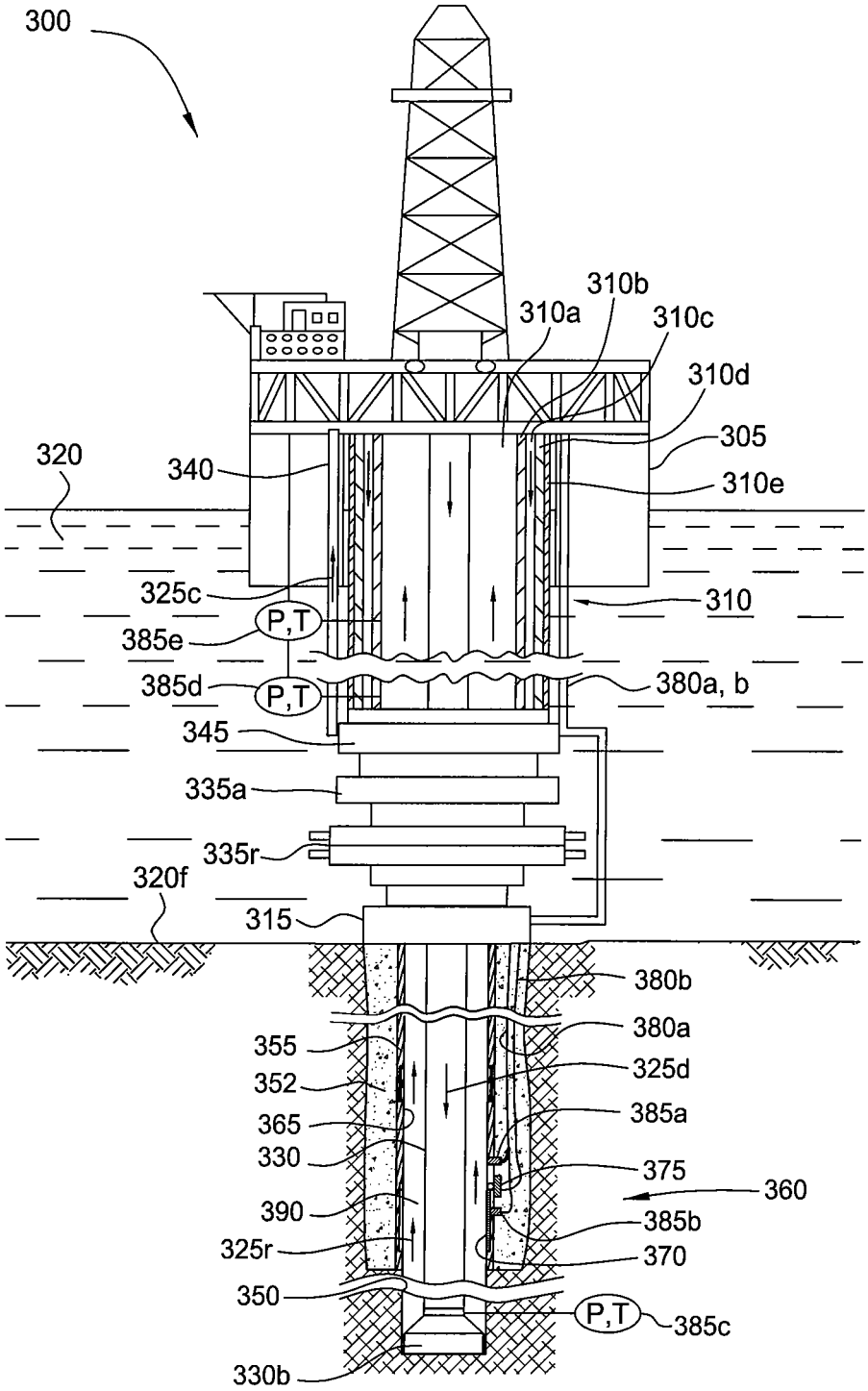
FIG. 3 illustrates an offshore drilling system, according to another embodiment of the present invention.

FIG. 3 illustrates an offshore drilling system 300, according to another embodiment of the present invention. A floating vessel 305 is shown but other offshore drilling vessels may be used. Alternatively, the drilling system 300 may be deployed for land-based operations in which case a land rig would be used instead and a riser would not be present. A concentric riser string 310 connects the floating vessel 305 and a wellhead 315 disposed on a floor 320*f* (or mudline) of the sea 320. The riser string 310 is exaggerated for clarity. Also connected to the wellhead are two or more ram-blowout preventers (BOPs) 335*r* and an annular BOP 335*a*. A riser diverter 345 is also connected to the wellhead 315. A coolant return line 340 extends from the diverter 345 to the floating vessel 305.

The floating vessel 305 includes a drilling rig. Many of the components used on the rig such as a top drive and/or rotary table (with Kelly), power tongs, slips, draw works and other equipment are not shown for ease of depiction. A wellbore 350 has already been partially drilled, casing 355 set and cemented 352 into place. The casing 355 may not extend into the hydrates formation (not shown) and may be installed by conventional methods. The cement 352 may be a low exothermic cement. The casing string 355 extends from the wellhead 315 at the seafloor 320*f*. A downhole deployment valve (DDV) 360 is installed in the casing 355 to isolate an upper longitudinal portion of the wellbore 350 from a lower longitudinal portion of the wellbore 350 (when the drillstring 330 is retracted into the upper longitudinal portion).

The drill string 330 includes a drill bit 330*b* disposed on a longitudinal end thereof. The drill string 330 may be made up of segments or joints of tubulars threaded together or coiled tubing. The drill string 330 may also include a bottom hole assembly (BHA) (not shown) that may include such equipment as a mud motor, a MWD/LWD sensor suite, and/or a check valve (to prevent backflow of fluid from the annulus), etc. As noted above, the drilling process requires the use of a drilling fluid 325*d*, which is stored in reservoir or mud tank (not shown). The drilling fluid 325*d* may be water, seawater, oil, foam, water/seawater or oil based mud, a mist, or a gas, such as nitrogen or natural gas. The reservoir is in fluid communication with one or more mud pumps (not shown, or a compressor if the drilling fluid is a gas or gas-based) which pump the drilling fluid 325*d* through conduit, such as pipe. The pipe is in fluid communication with an upper section of the drill string 330 that passes through a rotating control device (RCD) (not shown).

The RCD provides an effective annular seal around the drill string 330 during drilling and tripping operations. The RCD achieves this by packing off around the drill string. The RCD includes a pressure-containing housing where one or more packer elements are supported between bearings and isolated by mechanical seals. The RCD may be the active type or the passive type. The active type RCD uses external hydraulic pressure to activate the sealing mechanism. The sealing pressure is normally increased as the annular pressure increases. The passive type RCD uses a mechanical seal with the sealing action activated by wellbore pressure. If the drillstring 330 is coiled tubing or segmented tubing using a mud motor, a stripper (not shown) may be used instead of the RCD. The floating vessel may also include BOPs, similar to the subsea BOPs 335*a, r*.

The drilling fluid 325*d* is pumped into the drill string 330 via a Kelly, drilling swivel or top drive. The fluid 325*d* is pumped down through the drill string 330 and exits the drill bit 330*b*, where it circulates the cuttings away from the bit 330*b* and returns them up an annulus 390 defined between an inner surface of the casing 355 or wellbore 350 and an outer surface of the drill string 330. The return mixture 325*r* of drilling fluid 325*d* and cuttings (or simply returns) exits the wellbore 350 and travels to the floating vessel 305 via an annulus 310*a* formed between an inner surface of the riser 310 and an outer surface of the drill string 330. At or near the floating vessel 305, the returns are diverted through an outlet line of the RCD and a control valve or variable choke valve into one or more separators. The variable choke valve allows adjustable back pressure to be exerted on the annulus and may be between the RCD and the separators or in an outlet line of one of the separators. The separators (see FIG. 12), discussed in detail below, remove cuttings from the drilling fluid, may control disassociation of the gas hydrates, and returns the drilling fluid to the mud pump.

Additionally, a flow meter (not shown) may be provided in the RCD outlet line. The flow meter may be a mass-balance type or other high-resolution flow meter. Utilizing the flow meter, an operator will be able to determine how much fluid 325*d* has been pumped into the wellbore 350 through drill string 330 and the amount of returns 325*r* leaving the wellbore 350. Based on differences in the amount of fluid 325*d* pumped versus mixture 325*r* returned, the operator is be able to determine whether fluid 325*d* is being lost to a formation surrounding the wellbore 350, which may indicate that formation fracturing has occurred, i.e., a significant negative fluid differential. Likewise, a significant positive differential would be indicative of formation fluid entering into the well bore (a kick). In further addition, flow meters (not shown) may each be provided in the outlet line of the rig pump, and each outlet line from the separator.

The density and/or viscosity of the drilling fluid 325*d* can be controlled by automated drilling fluid control systems. Not only can the density/viscosity of the drilling fluid be quickly changed, but there also may be a computer calculated schedule for drilling fluid density/viscosity increases and pumping rates so that the volume, density, and/or viscosity of fluid passing through the system is known. The pump rate, fluid density, viscosity, and/or choke orifice size can then be varied to control the annulus pressure profile.

The provision of the concentric riser 310 allows for a coolant 325*c* to be circulated through an outer annulus 310*c* of the riser 310 during drilling, thereby providing temperature control of the returns 325*r* in the riser annulus 310*a* by controlling an injection temperature and injection rate of the coolant 325*c*. A refrigeration system (not shown) on the floating platform 305 refrigerates the coolant 325*c* which is then injected into the outer annulus 310*c* and receives heat energy from the returns 325*r*. The spent cooling fluid 325*c* flows through the riser diverter 345 and into the coolant return line 340 where it is transported to the floating platform 305 and recirculated through the refrigeration system. Alternatively, the coolant may be expelled into the sea 320. To minimize heat loss to the sea 320, a thermally insulating material 310*e* may be disposed along an outer surface of an outer tubular 310*d* of the riser string 310.

Suitable coolants include seawater; water; antifreeze: such as a glycol (or a mixture of glycols), for example ethylene or propylene glycol; oil; alcohol, and a mixture of antifreeze and water or seawater. Alternatively, cooled refrigerant from the refrigeration system could be instead directly injected into the riser annulus. Examples of suitable refrigerant include gas, natural gas, propane, nitrogen, and any other known refrigerant (R-10-R-2402). The refrigerant may even be supplied by the separator from the wellbore 350 or any other proximate wellbore. If nitrogen is used for the refrigerant, it may be supplied by a nitrogen generator. The drilling fluid 325*d* may be injected into the drill string at ambient temperature or may be cooled using the refrigeration system before injection into the drill string 330. Alternatively, any of the above listed coolants may be used as the drilling fluid 325*d*.

Alternatively, the drilling fluid 325*d* and/or the coolant 325*c* may instead be heated. In this alternative, subsea and/or subsurface disassociation in a controlled manner would be encouraged. Further, heating the drilling fluid 325*d* and/or the coolant 325*c* may be in response to a frigid ambient temperature. A heated drilling system may also be beneficial for drilling other formations, for example tar sands or heavy, viscous crude oil. Heating of the tar sand or heavy crude oil reduces the viscosity, which allows recovery from the formation.

If the drilling system 300 is land based, then the casing string 355 may be a concentric casing string. Coolant 325*c* could then be circulated through an outer annulus to provide temperature control while drilling, similar to the concentric riser string 310. The coolant 325*c* could be return to the surface via a parasite string disposed along an outer surface of the casing string 355 or mixed with the returns 325*r*. Alternatively, the casing string 355 may be a concentric casing string for the subsea drilling system 300 as well to provide additional temperature control. In this alternative, separate coolant delivery and return lines could extend from the floating platform 305 to the wellhead 315 or the outer annulus be placed in fluid communication with the riser coolant circulation system. Further, the use of a concentric string may also be used to transfer heat generated during a cementing operation to the surface instead of into a hydrates formation.

The DDV 360 includes a tubular housing 365, a flapper 370 having a hinge at one end, and a valve seat in an inner diameter of the housing 365 adjacent the flapper 370. A more detailed discussion of the DDV 360 may be found in U.S. patent application Ser. No. 10/288,229 and U.S. patent application Ser. No. 10/677,135 which are herein incorporated by reference in their entireties. Alternatively, a ball valve (not shown) may be used instead of the flapper 370. Alternatively, instead of the DDV 360, an instrumentation sub (see FIG. 3D) including a pressure and temperature (PT) sensor without the valve may be used. The housing 365 may be connected to the casing string 355 with a threaded connection, thereby making the DDV 360 an integral part of the casing string 355 and allowing the DDV 360 to be run into the wellbore 350 along with the casing string 355 prior to cementing. Alternatively, see (FIG. 3F) the DDV 360 may be run in on a tie-back casing string.

The housing 365 protects the components of the DDV 360 from damage during run in and cementing. Arrangement of the flapper 370 allows it to close in an upward fashion wherein pressure in a lower portion of the wellbore will act to keep the flapper 370 in a closed position. The DDV 360 is in communication with a rig control system (RCS) (not shown) to permit the flapper 370 to be opened and closed remotely from the floating vessel 305. The DDV 360 further includes a mechanical-type actuator 375 (shown schematically), such as a piston, and one or more control lines 380*a,b* that can carry hydraulic fluid, electrical currents, and/or optical signals. As shown, line 380*a* includes a data line and a power line and line 380*b* is a hydraulic line. Clamps (not shown) can hold the control lines 380*a,b* next to the casing string 355 at regular intervals to protect the control lines 380*a,b*. Physically, the control lines 380*a, b* may be bundled together in an integrated conduit (not shown).

The flapper 370 may be held in an open position by a tubular sleeve (not shown) coupled to the piston. The sleeve may be longitudinally moveable to force the flapper 370 open and cover the flapper 370 in the open position, thereby ensuring a substantially unobstructed bore through the DDV 370. The hydraulic piston is operated by pressure supplied from the control line 380*b* and actuates the sleeve. Alternatively, the sleeve may be actuated by interactions with the drill string based on rotational or longitudinal movements of the drill string. Additionally, a series of slots and pins (not shown) permits the DDV 360 to be selectively locked into an opened or closed position. A valve seat (not shown) in the housing 365 receives the flapper 370 as it closes. Once the sleeve longitudinally moves out of the way of the flapper 370, a biasing member (not shown) may bias the flapper 160 against the valve seat. The biasing member may be a spring.

The DDV 360 may further include one or more PT sensors 385*a, b*. As shown, an upper PT sensor 385*a* is placed in an upper portion of the wellbore 350 (above the flapper 370) and a lower PT sensor 385*b* placed in the lower portion of the wellbore (below the flapper 370 when closed). Each of the PT sensors may be physically separate sensors. The upper PT sensor 385*a* and the lower PT sensor 385*b* can determine a fluid pressure and temperature within an upper portion and a lower portion of the wellbore, respectively. Additional sensors (not shown) may optionally be located in the housing 365 of the DDV 150 to measure any wellbore condition or DDV parameter, such as a position of a sleeve (not shown) and the presence or absence of a drill string. The additional sensors may also/instead determine a fluid composition, such as a liquid to gas ratio. The sensors may be connected to a local controller (not shown) in the DDV 360. Power supply to the controller and data transfer therefrom to the RCS is achieved by the control line 380*a*. Alternatively, the DDV may be controlled by the RCS without a control line 380*a*.

When the drill string 330 is moved longitudinally above the DDV 360 and the DDV 360 is in the closed position, the upper portion of the wellbore 100 is isolated from the lower portion of the wellbore 100 and any pressure remaining in the upper portion can be bled out through the choke valve at the floating vessel 305. Isolating the upper portion of the wellbore facilitates operations such as inserting or removing a BHA. In later completion stages of the wellbore 350, equipment, such as perforating systems, screens, or slotted liner systems may also be inserted/removed in/from the wellbore 350 using the DDV 360. Because the DDV 360 may be located at a depth in the wellbore 350 which is greater than the length of the BHA or other equipment, the BHA or other equipment can be completely contained in the upper portion of the wellbore 100 while the upper portion is isolated from the lower portion of the wellbore 350 by the DDV 360 in the closed position.

The sensors 385*a, b* may be electro-mechanical sensors or solid state piezoelectric or magnetostrictive materials. Alternatively, the sensors 385*a, b* may be optical sensors, such as those described in U.S. Pat. No. 6,422,084, which is herein incorporated by reference in its entirety. For example, the optical sensors 385*a, b* may comprise an optical fiber, having the reflective element embedded therein; and a tube, having the optical fiber and the reflective element encased therein along a longitudinal axis of the tube, the tube being fused to at least a portion of the fiber. Alternatively, the optical sensor 362 may comprise a large diameter optical waveguide having an outer cladding and an inner core disposed therein. Alternatively, the sensors 165*a,b* may be Bragg grating sensors which are described in commonly-owned U.S. Pat. No. 6,072,567, entitled "Vertical Seismic Profiling System Having Vertical Seismic Profiling Optical Signal Processing Equipment and Fiber Bragg Grafting Optical Sensors", issued Jun. 6, 2000, which is herein incorporated by reference in its entirety. Construction and operation of the optical sensors suitable for use with the DDV 360, in the embodiment of an FBG sensor, is described in the U.S. Pat. No. 6,597,711 issued on Jul. 22, 2003 and entitled "Bragg Grating-Based Laser", which is herein incorporated by reference in its entirety. Each Bragg grating is constructed so as to reflect a particular wavelength or frequency of light propagating along the core, back in the direction of the light source from which it was launched. In particular, the wavelength of the Bragg grating is shifted to provide the sensor.

The optical sensors 385*a, b* may also be FBG-based interferometer sensors. An embodiment of an FBG-based interferometer sensor which may be used as the optical sensors 165*a,b* is described in U.S. Pat. No. 6,175,108 issued on Jan. 16, 2001 and entitled "Accelerometer featuring fiber optic bragg grating sensor for providing multiplexed multi-axis acceleration sensing", which is herein incorporated by reference in its entirety. The interferometer sensor includes two FBG wavelengths separated by a length of fiber. Upon change in the length of the fiber between the two wavelengths, a change in arrival time of light reflected from one wavelength to the other wavelength is measured. The change in arrival time indicates pressure and/or temperature measured by one of the sensors 385*a, b*. Instead of discrete optical sensors 385*a,b* a continuous sensor for pressure and a continuous sensor for temperature may extend along an inner wall (or be embedded therein).

The RCS may include a hydraulic pump and a series of valves utilized in operating the DDV 360 by fluid communication through the control line 380*a*. The RCS may also include a programmable logic controller (PLC) based system or a central processing unit (CPU) based system for monitoring and controlling the DDV and other parameters, circuitry for interfacing with downhole electronics, an onboard display, and standard RS-232 interfaces (not shown) for connecting external devices. In this arrangement, the RCS outputs information obtained by the sensors and/or receivers in the wellbore to the display. The pressure differential between the upper portion and the lower portion of the wellbore can be monitored and adjusted to an optimum level for opening the DDV. In addition to pressure information near the DDV, the system can also include proximity sensors that describe the position of the sleeve in the valve that is responsible for retaining the valve in the open position. By ensuring that the sleeve is entirely in the open or the closed position, the valve can be operated more effectively. A separate computing device such as a laptop can optionally be connected to the RCS. A satellite, microwave, or other long-distance data transceiver or transmitter may be provided in electrical communication with the RCS for relaying information from the RCS to a satellite or other long-distance data transfer medium. The satellite relays the information to a second transceiver or receiver where it may be relayed to the Internet or an intranet for remote viewing by a technician or engineer.

To provide increased monitoring capability, PT sensors 385*c-e* may be provided in the drill string 330 near the bit 330*b* and spaced along the riser 310 in fluid communication with the returns 325*r*. The sensors 385*c-e* may be any of the sensors discussed above for sensors 385*a, b*. A line provides electrical/optical communication between the sensors 385*d, e* and the RCS. The data provided by the sensors 385*a-e* will allow the RCS to monitor pressure and temperature in the annuli 310*a*, 390 to ensure that the temperature and pressure are either within the hydrates drilling window DW or disassociating at a manageable rate.

Pressure and temperature control may be maintained during a tripping operation and/or while adding segments to the drill string 330 via the addition of a continuous circulation system (CCS) (not shown) on the floating vessel 305. The CCS allows circulation of drilling fluid 325*d* to be maintained while adding or removing joints to the drill string 330. A suitable CCS system is illustrated and described in U.S. Prov. App. No. 60/824,806, filed Sep. 7, 2006, which is hereby incorporated by reference in its entirety.

Figure 3A:
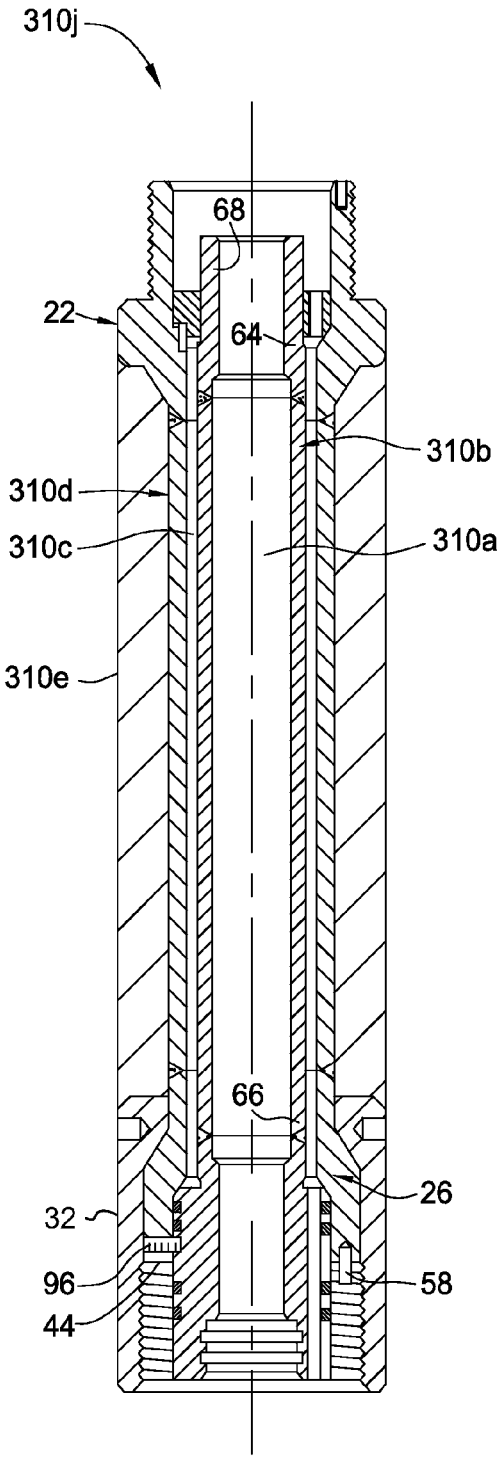
FIG. 3A is an longitudinal sectional view of a concentric riser joint of the riser of FIG. 3, and with the section on the left hand side being cut at a 135 degree angle with respect to the right hand side.
Figure 3B:
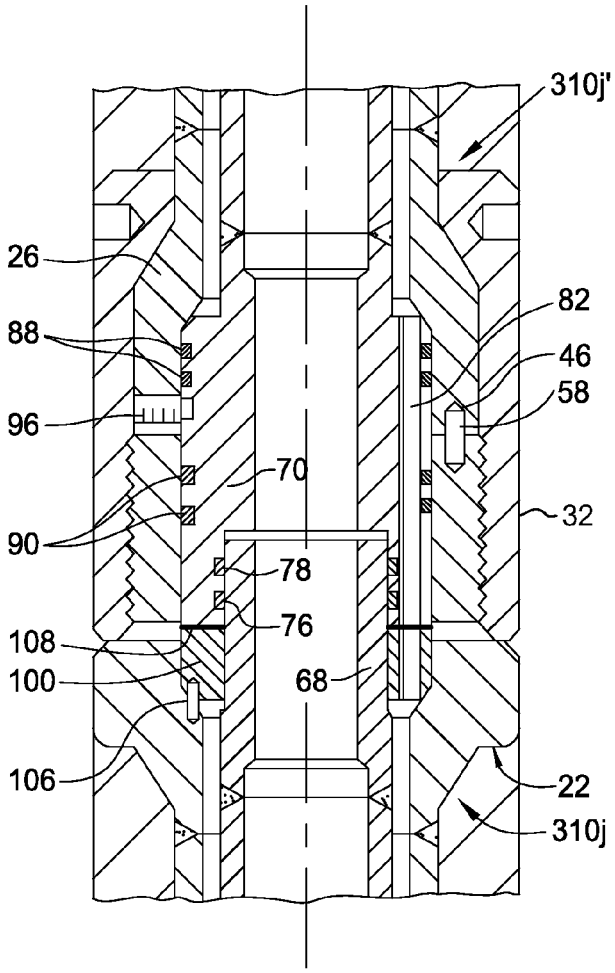
FIG. 3B is an longitudinal sectional view of a coupling joining an upper concentric riser joint to a lower concentric riser joint, and with the section on the left hand side being cut at a 135 degree angle with respect to the right hand side.

FIG. 3A is an longitudinal sectional view of a concentric riser joint 310*j* of the riser 310 of FIG. 3, and with the section on the left hand side being cut at a 135 degree angle with respect to the right hand side. FIG. 3B is an longitudinal sectional view of a coupling joining an upper concentric riser joint 310*j*' to a lower concentric riser joint 310*j*, and with the section on the left hand side being cut at a 135 degree angle with respect to the right hand side. The riser joint 310*j* includes an outer tubular 310*d* having a longitudinal bore therethrough and an inner tubular 310*b* having a longitudinal bore 310*a* therethrough. The inner tubular 310*b* is mounted within the outer tubular 310*d*. An annulus 310*c* is formed between the inner 310*b* and outer 310*d* tubulars.

The outer tubular 310*d* has a pin 22 connected to a first end and a box 26 connected to a second end thereof. The box 26 has a longitudinal bore therethrough with an internal circumferential tapered shoulder. A nut 32 is installed on the box 26. The nut 32 has an internal circumferential shoulder cooperatively engaging an external circumferential shoulder of the box 26. The nut 32 is allowed to rotate relative to the box 26 while being limited in longitudinal movement by the abutting circumferential shoulders. The nut 32 includes an internally threaded end portion. One or more radial blind bores are formed in the nut 32 for receiving a spanner bar (not shown) to rotate the nut 32.

The pin 22 has a longitudinal bore therethrough with an internal circumferential tapered shoulder. The pin 22 includes an externally threaded end portion corresponding to the internally threaded end portion of the nut 32. The box 26 includes a lower end face with a plurality of longitudinal blind bores therein. The pin 22 includes an upper end face with a plurality of longitudinal blind bores therein. The longitudinal blind bores of the box 26 are longitudinally aligned with the longitudinal blind bores of the pin end coupling 22. Alignment pins 58 are fixedly received in the blind bores of the box 26 and adapted to be slidably received in the blind bores of the pin 22.

The inner tubular 310*b* has a first end and a second end. The first end has a stab portion 68 welded thereto. A seal sub 70 is welded to the second end of the inner tubular 310*b*. The seal sub 70 has a central longitudinal bore therethrough with a receiving end portion. A plurality of circumferentially spaced longitudinal passageways surround the central longitudinal bore. The receiving end portion includes a pair of internal circumferential grooves for receiving seal 78. The seal sub 70 has an end face and an upper face. An upper pair of external circumferential grooves and a lower pair of external circumferential grooves for receiving box seal 88 and pin seal 90, respectively, are provided in the outer surface of the seal sub 70.

The seal sub 70 is partially received in the longitudinal bore of the box 26. The upper face of the seal sub 70 is positioned at the internal circumferential tapered shoulder of the box 26.

The lower end face of the seal sub 70 extends beyond the lower end face of the box 26. The pair of box seals 88 provides a fluid tight seal between the box 26 and the seal sub 70. The seal sub 70 has a plurality of radial blind holes in longitudinal alignment with a plurality of radial holes extending through the box 26. The seal sub 70 is affixed to the box 26 by retaining pins 96 inserted into the radial holes and extending into the aligned radial blind holes. The retaining pins 96 prevent both longitudinal and rotational movement of the inner tubular 310*b* relative to the outer tubular assembly 310*d*.

A cylindrical retainer plate 100 is received in the longitudinal bore of the pin 22. The cylindrical retainer plate 100 has an inner bore for receiving the stab portion 68 of the inner tubular 310*b* therethrough. The retainer plate 100 further includes a plurality of circumferentially spaced longitudinal bores extending therethrough and surrounding the inner bore. The retainer plate 100 is restricted from rotational movement relative to the pin 22 by a pin 106 interconnecting the retainer plate 100 and the pin 22. The retainer plate 100 is installed in the pin 22 so that the plurality of longitudinal bores are in longitudinal alignment with the plurality of longitudinal passageways of the seal sub 70 installed in the box 26.

The longitudinal movement of the retainer plate 100 relative to the pin 22 is restricted at the lower end of the retainer plate 100 by abutting contact with the internal circumferential tapered shoulder of the pin 22. The longitudinal movement of the retainer plate 100 relative to the pin 22 is restricted at its upper end by abutting contact with a retainer ring 108 inserted in a retainer ring groove. The stab portion 68 extends through the inner bore of the retainer plate 100 and is adapted to be slidably received in the receiving end portion of a seal sub 70 of an adjoining riser joint 310*j'*. The concentric riser joint 310*j* is merely an example of a suitable concentric riser. Any other known concentric riser may be used instead.

Figure 3C:
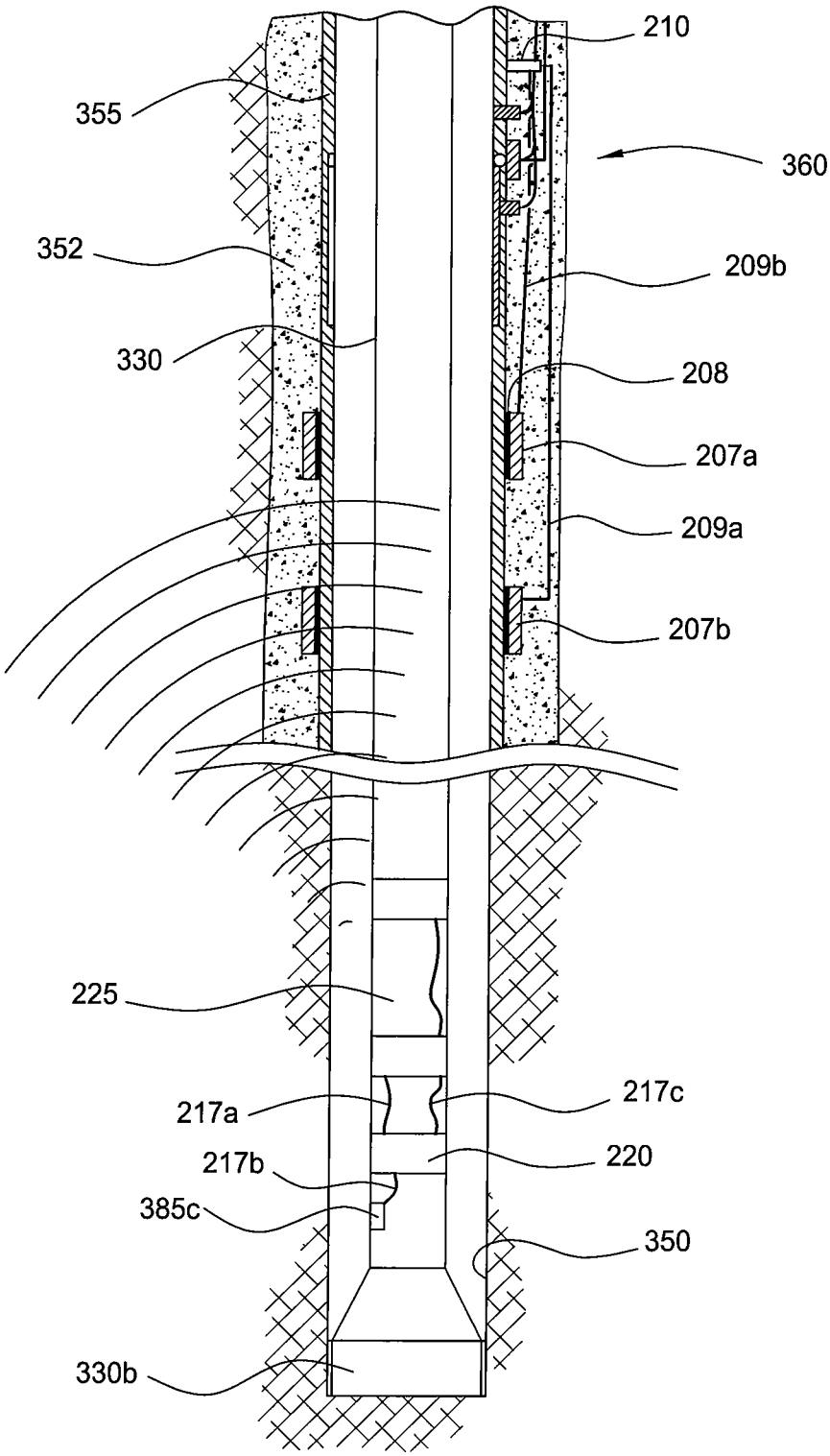
FIG. 3C is an exemplary downhole configuration for use with drilling system of FIG. 3.

FIG. 3C is an exemplary downhole configuration for use with drilling system 300. FIG. 3C illustrates data communication between PT sensor 385*c* and the DDV 360. The drill string 330 may further include a local controller 220 and EM gap sub 225. A suitable gap sub is disclosed in US Pat. App. Pub. 2005/0068703, which is hereby incorporated by reference in its entirety. The PT sensor 385*c* is in electrical or optical communication with the controller 220 via line 217*b*. The controller 220 receives an analog pressure and temperature signal from the sensor 385*c*, samples the pressure signal, modulates the signal, and sends the signal to a casing antenna 207*a,b* via the EM gap sub 225. The controller 220 is in electrical communication with the EM gap sub 225 via lines 217*a,c*. The controller may include a battery pack (not shown) as a power source. The casing antenna 207*a,b* may be disposed in the casing string 355 below the DDV 360. The casing antenna 207*a,b* may be a sub that attaches to the DDV 360 with a threaded connection. The EM casing antenna system 207*a,b* includes two annular or tubular members that are mounted coaxially onto a casing joint. The two antenna members 207*a,b* may be substantially identical and may be made from a metal or alloy. The casing joint may be selected from a desired standard size and thread. A radial gap exists between each of the antenna members 207*a,b* and the casing joint, and is filled with an insulating material 208, such as epoxy.

The antenna members 207*a,b* can act as both transmitter and receiver antenna elements. The antenna members 207*a,b* receive the signal and relay the signal to a local controller 210 via lines 209*a,b*. The controller 210 demodulates the signal, remodulates the signal for transmission to the RCS, and multiplexes the signal with signals from the PT sensors 385*a,b*. Alternatively, the controller 210 may simply be an amplifier and have a dedicated control line to the RCS. Alternatively, the PT data my be transmitted to the RCS via mud-pulse (not-shown) or the drill string 330 may be wired.

Figure 3D:
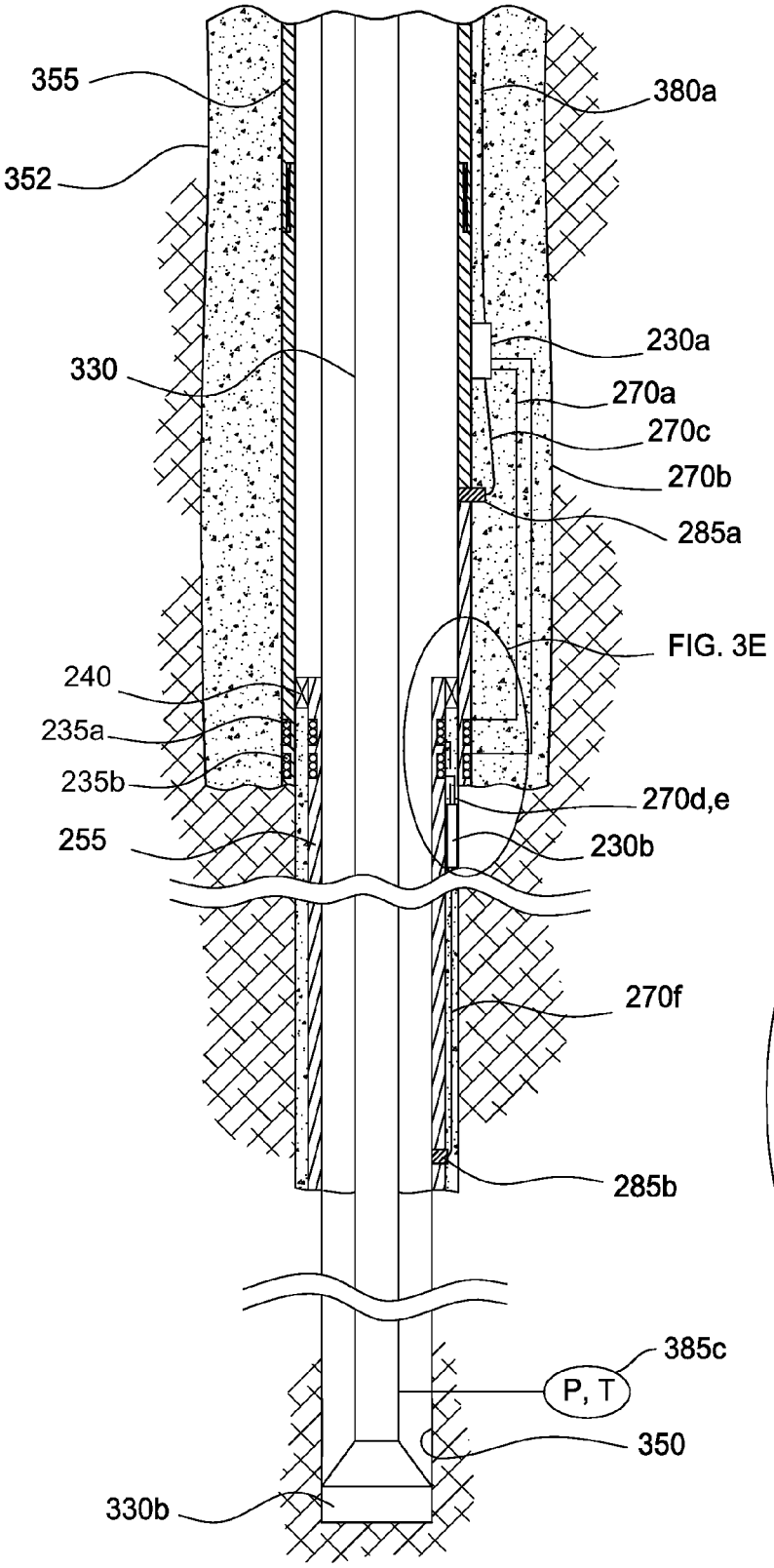
FIG. 3D is an alternate downhole configuration for use with drilling system of FIG. 3.
Figure 3E:
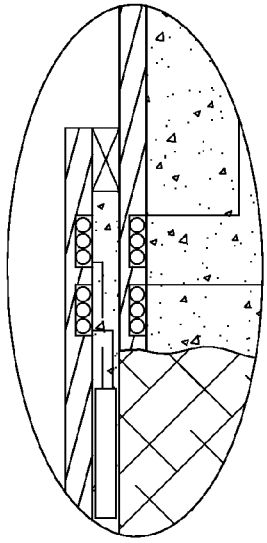
FIG. 3E is an enlargement of a portion of FIG. 3D.

FIG. 3D is an alternate downhole configuration for use with the drilling system 300. FIG. 3E is an enlargement of a portion of FIG. 3D. A PT sensor 285*a* is included in the casing string 355 instead of the DDV 360. Alternatively, the DDV 360 may be included in the casing string 355. The PT sensor 285*a* is in electrical or optical communication with a local controller 230*a* via line 270*c*. A PT sensor 285*b* is disposed near a second longitudinal end of a liner 255. Alternatively, a DDV (or second DDV) may be included in the liner instead of just the PT sensor 265*b*. The liner DDV may have an electric actuator instead of a hydraulic actuator. The sensor 285*b* is in electrical or optical communication with the liner controller 230*b* via line 270*f*. The liner 215*a* has been hung from the casing string 355 by anchor 240. The anchor 240 may also include a packing element. The liner 255*a* is cemented 352 in place.

Disposed near a longitudinal end of the casing string 355 is a part of an inductive coupling 235*a* and a part of an inductive coupling 235*b*. The other parts of the inductive couplings 235*a, b* are disposed near a first longitudinal end of the liner 255. The casing controller 230*a* is in electrical communication with each part of the couplings 235*a, b* via lines 270*a,b*, respectively. One of the couplings 235*a, b* is used for power transfer and the other coupling 235*a, b* is used for data transfer. The liner controller 230*b* is in electrical communication with each part of the couplings via lines 270*d, e*, respectively. Alternatively, only one inductive coupling may be used to transmit both power and data. In this alternative, the frequencies of the power and data signals would be different so as not to interfere with one another.

The couplings 235*a, b* are an inductive energy/data transfer devices. The couplings 235*a, b* may be devoid of any mechanical contact between the two parts of each coupling. Each part of each of the couplings 235*a, b* include either a primary coil or a secondary coil. Each of the coils may be strands of wire made from a conductive material, such as aluminum or copper, wrapped around a groove formed in the casing 355 or liner 255. The wire is jacketed in an insulating polymer, such as a thermoplastic or elastomer. The coils are then encased in a polymer, such as epoxy. In general, the couplings 235*a, b* each act similar to a common transformer in that they employ electromagnetic induction to transfer electrical energy/data from one circuit, via a primary coil, to another, via a secondary coil, and do so without direct connection between circuits. In operation, an alternating current (AC) signal generated by a sine wave generator included in each of the controllers 230*a, b*.

For the power coupling, the AC signal is generated by the casing controller 230*a* and for the data coupling the AC signal is generated by the liner controller 230*b*. When the AC flows through the primary coil the resulting magnetic flux induces an AC signal across the secondary coil. The liner controller 230*b* also includes a rectifier and direct current (DC) voltage regulator (DCRR) to convert the induced AC current into a usable DC signal. The casing controller 230*a* may then demodulate the data signal and remodulate the data signal for transmission along the line 380*a* to the RCS (multiplexed with the signal from the PT sensor 285*a*). The couplings 225*a, b* are sufficiently longitudinally spaced to avoid interference with one another. Alternatively, or in addition to the couplings 225*a, b*, conventional slip rings, roll rings, or transmitters using fluid metal may be used.

Figure 3F:
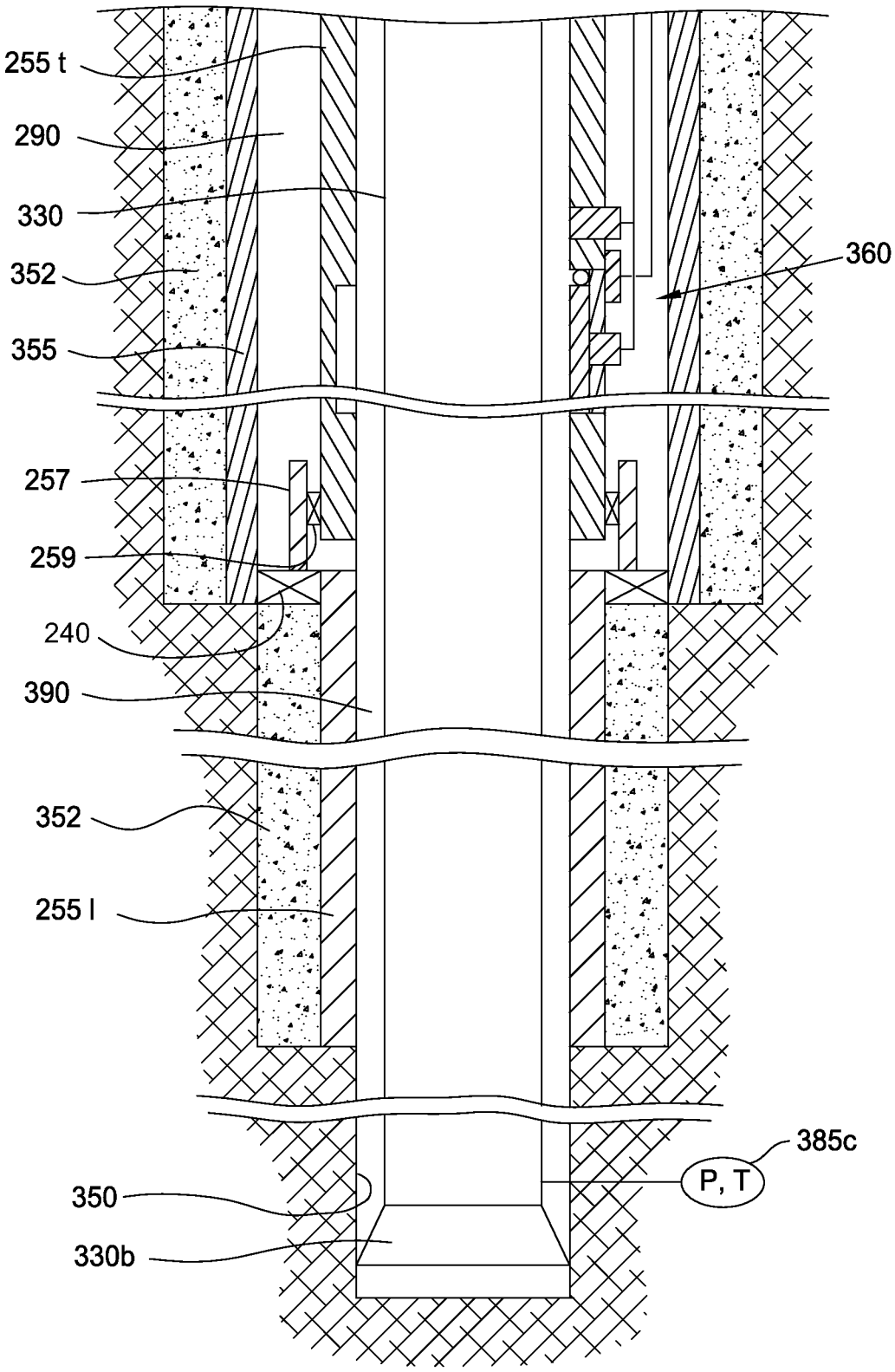
FIG. 3F is another alternate downhole configuration for use with drilling system of FIG. 3.

FIG. 3F is another alternate downhole configuration for use with the drilling system 300 of FIG. 2-2D. In this configuration, the string of casing 355 does not include the DDV. A liner 255*l* has been hung from the casing string 355 by anchor 240. The anchor 240 may also include a packing element. The liner 255*l* is also cemented 352 in place. Attached to the anchor 240 is a polished bore receptacle (PBR) 257. A tieback casing string 255*t*, including the DDV 360 is also hung from the wellhead and disposed within the casing string 355. Alternatively, a pressure sensor (without the valve) may be disposed in the tieback casing 255*t*. Disposed along an outer surface near a longitudinal end of the tieback casing string is a sealing element 259. As the tieback casing string 255*t* is inserted into the PBR 257, the sealing element 259 engages an inner surface of the PBR 257, thereby forming a seal therebetween and isolating an annulus 290 defined between an inner surface of the casing string 355 and an outer surface of the tieback string 255*t* from the annulus 390 defined between an inner surface of the tieback casing 255*t*/liner 255*l* and an outer surface of the drill string 330. The DDV 360 is able to isolate (with the drillstring 330 removed) a bore of the tieback casing 255*t* from a bore of the liner 255*l*, thereby effectively isolating an upper portion of the wellbore 350 from a lower portion of the wellbore 350 (the annulus 290 may not be isolated by the DDV 360 since it isolated by the seal 259 but may be isolated in an alternative embodiment). The return mixture 325*r* travels to the seafloor 320*f* via the annulus 390.

Figure 4:
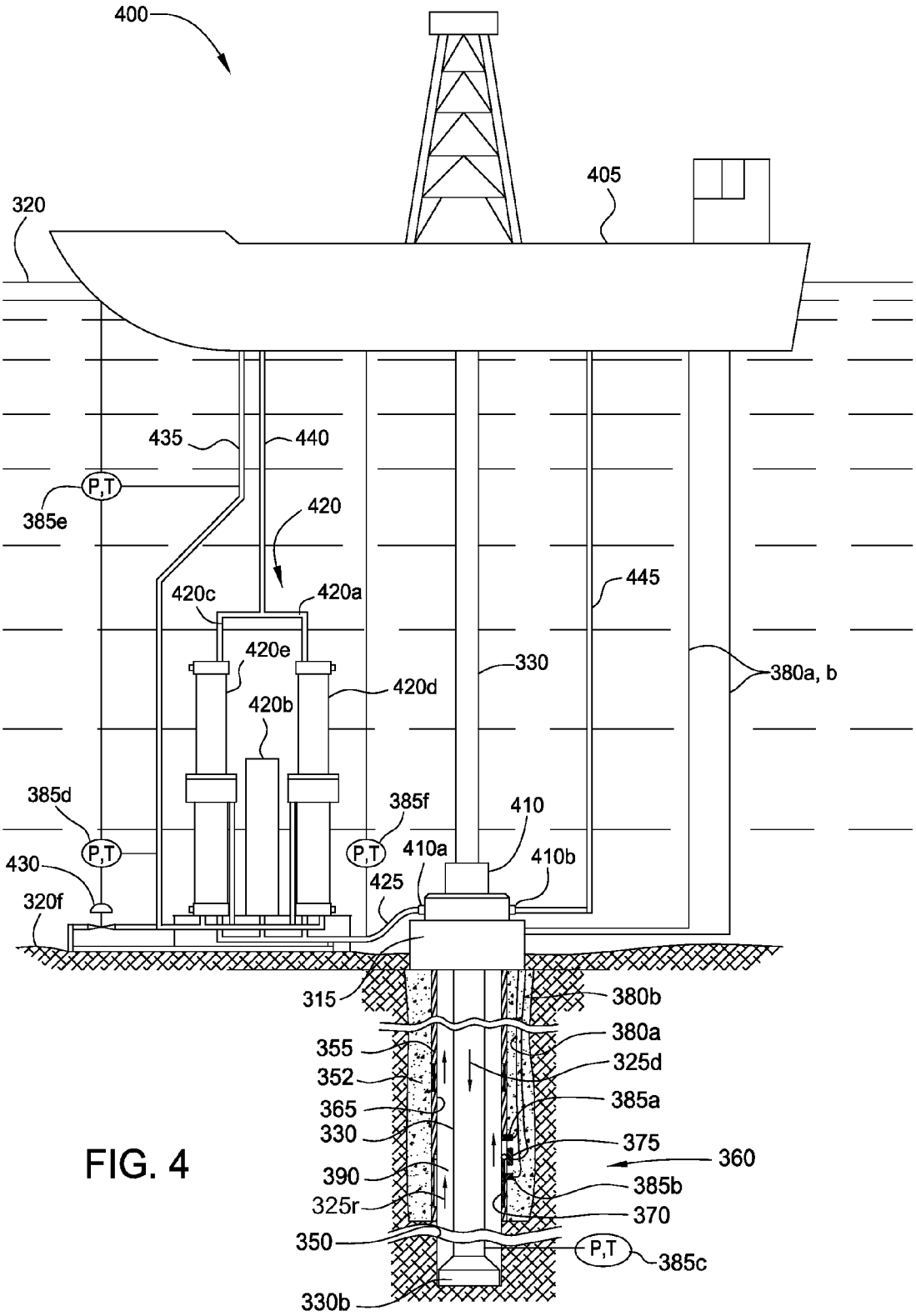
FIG. 4 illustrates an offshore drilling system, according to another embodiment of the present invention.

FIG. 4 illustrates an offshore drilling system 400, according to another embodiment of the present invention. As compared to the drilling system 300, the drilling system 400 is riserless so a drill ship 405 is shown but other offshore drilling vessels may be used. Alternatively, the drilling system 400 may be deployed for land-based operations in which case a land rig would be used instead of the drill ship 405. The drill ship 405 includes a drilling rig and may also include other associated components discussed above with reference to the floating vessel 305. Because the drilling system 400 is riserless, an RCD 410 is attached to the wellhead in sealing engagement with an outer surface of the drill string 330.

Instead of returning through the riser, the returns 325*r* are diverted by the RCD 410 to an outlet 410*a* of the RCD 410 which connects the annulus 390 to a wellbore line 425. Although not shown, the wellhead 315 may also include the BOPs 335*a, r*. The wellbore line 425 provides a fluid passageway between the annulus 390 and a multi-phase pump 420 disposed on the seafloor 320*f* adjacent the wellhead 315. The returns 325*r* are pumped via the multiphase pump 420 through a discharge line 435 to the drill ship 405. An optional recirculation line having a variable choke valve 430 allows for pressure control of the discharge line 435. Alternatively or in addition to, pressure control of the discharge line 435 may be provided as discussed above for the drilling system 300.

A high-pressure power fluid is supplied through a high pressure fluid line 440 to operate the multiphase pump 420. Typically, the power fluid is seawater that is pumped from the drill ship 405 to the multiphase pump 420 at an initial operating pressure. As the seawater travels through the line 440, the seawater increases in pressure due to a pressure gradient force of the seawater. After use by the multi-phase pump 420, the seawater is expelled to the sea 320.

The high pressure fluid line 440 supplies power fluid to either one of plunger assemblies 420*d, e* during a pumping cycle. For instance, as the first plunger assembly 420*d* is expelling wellbore fluid into the discharge line 435, the fluid line 440 will supply power fluid to assembly 420*d* via a fluid line 420*a*. Conversely, as the second plunger assembly 420*e* is expelling wellbore fluid into the discharge line 435, the fluid line 440 will supply power fluid to second plunger assembly 420*e* via a fluid line 420*c*.

The multiphase pump 200 includes a first plunger (not shown) and a second plunger (not shown), each movable between an extended position and a retracted position within the plunger assemblies 420*d, e*, respectfully. A first lower valve (not shown) and a first upper valve (not shown) controls the movement of the first plunger while the movement of the second plunger is controlled by a second lower valve (not shown) and a second upper valve (not shown). The upper and lower valves may be slide valves and can operate in the presence of solids. The upper and lower valves are synchronized and operated a controller (i.e., a local controller or the RCS). During operation, the lower valves allow returns 325*r* from the wellbore line 425 to fill and vent a first lower chamber and a second lower chamber, respectfully. The upper valves allow high pressure power fluid from the fluid lines 420*a, b* to fill and vent a first upper chamber and a second upper chamber, respectfully.

The first plunger moves toward the extended position as the returns 425*d* enter through the first lower valve to fill the first lower chamber with fluid from the wellbore line 425. At the same time, power fluid in the first upper chamber vents through an outlet of the first upper valve 260 into the surrounding sea 320. Simultaneously, the second plunger moves in an opposite direction toward the retracted position as power fluid from the fluid line 420*c* flows through the second upper valve and fills the second upper chamber, thereby expelling the returns 325*r* in the second lower chamber through the second lower valve and into the discharge line 435. As the first plunger reaches its full extended position, the second plunger reaches its full retracted position, thereby completing a cycle. The first plunger then moves toward the retracted position as power fluid from the fluid line 420*a* flows through the first upper valve and fills the first upper chamber, thereby expelling the returns in the first lower chamber into the discharge line 435, as the second plunger moves toward the extended position filling the second lower chamber with returns 325*r* from the line 425. In this manner, the plungers operate as a pair of substantially counter synchronous fluid pumps.

The plungers move in opposite directions causing continuous flow of returns 325*r* from the wellbore line 425 to the discharge line 435. However, as the plungers change direction, the plungers will slow down, stop, and accelerate in the opposite direction. This pause of the plungers could introduce undesirable changes in the back pressure on the annulus 390, since the inlet flow line 425 is directly connected to the flow of returns 325*r*. Therefore, a pulsation control assembly 420*b* is employed in the multiphase pump 420 to control backpressure due to change of direction of plungers during the pump cycle.

Generally, the pulsation control assembly 420*b* is a gas filled accumulator that is connected to the inlet line of both plunger assemblies 420*d, e* by a pulsation port. During normal flow, the in flow pressure will enter through the port and slightly fill the pulsation control assembly 420*b*. As the first plunger starts to slow down near the end of its stroke, the flow coming from the annulus 390 will increase its pressure slightly driving an accumulator piston (not shown) further up and into pulsation control assembly 420*b* as it tries to balance pressures across the piston. As the first plunger stops, the opposite plunger begins to increase its intake speed, causing the inlet pressure to drop slightly, which will allow the stored fluid in the pulsation control assembly 420*b* to come back out through port. This process will repeat itself throughout the pump cycle as each plunger reverses stroke.

A seal assembly (not shown) is disposed around each of the plungers to accommodate the returns 325*r* as well as the power fluid. Each of the seal assemblies include a member to constantly scrape and polish the plungers, and can eliminate solid particles from the seal assembly 280 area thereby insuring its useful life and protecting the sealing elements. Generally, each seal assembly includes a ring that is disposed on either side of a sealant. During the operation of the multiphase pump 420, the rings scrape and polish the plungers. The sealant may be replenished locally or by remote injection during pump operations to replenish and improve its life expectancy.

The multi-phase pump 420 further includes a first gas line and a second gas line disposed on the first plunger assembly and second plunger assembly, respectfully. Generally, the gas lines are used to prevent gas lock of the plungers during operation of the multi-phase pump 420. The first gas line connects an auxiliary gas port at the upper end of the first lower chamber to the discharge line 435. Similarly, the second gas line connects an auxiliary gas port at the upper end of the second lower chamber to the discharge line 435. Gas entering the multiphase pump 420 from the wellbore line 425 will be compressed by the plungers and thereafter expelled from the lower chambers through the ports into the discharge line 435.

Alternatively, the multiphase pump 420 may be a diaphragm pump, a jet pump, a Moineau pump, or an equivalent circulation density reduction tool (ECDRT). The ECDRT is described in the U.S. Pat. No. 6,837,313 and U.S. Prov. App. 60/777,593, filed Feb. 28, 2006, which are hereby incorporated by reference in their entireties. The ECDRT includes a turbine, other fluid powered motor (i.e., Moineau motor), or an electric motor and a pump assembled as part of the drill string. The turbine harnesses energy from the drilling fluid and powers the pump. Returns are diverted from the annulus through the pump. If the drilling system 400 is land based, the multiphase pump 420 will be disposed in the wellbore 350. Alternatively, instead of the multiphase pump 420, the returns may be collected one or more containers, such as inflatable bladders. The containers may include a buoyancy source that is charged with a light medium when the containers are full, thereby floating the containers to the surface. Such a system is described in U.S. Pat. App. Pub. No. 2004/0031623, which is hereby incorporated by reference in its entirety.

To discourage disassociation of the hydrates cuttings in the returns 325*r* in the inlet of the multiphase pump 420, an optional coolant line 445 is provided from the drill ship 405 to a second outlet 410*b* of the RCD 410. The coolant may be liquid nitrogen, natural gas, or any of the coolants 325*c* discussed above for the drilling system 300. Alternatively, the coolant may be refrigerated drilling fluid 325*d*. The coolant would mix with the returns 325*r* and would enter the multiphase pump therewith. Alternatively, instead of a coolant line the power fluid line 440, the wellbore line 425, and the discharge line 435 could each be concentric lines, similar to the riser 310, with additional lines connecting the outer annuli thereof to form a coolant circuit and coolant could then be circulated therein. In a variation of this alternative, coolant could be used as the power fluid and return to the drill ship 405 through a concentric discharge line 435 (and also be circulated through a concentric wellbore line 425.

Similar to the drilling system 300, PT sensors 385*d-f* are provided in fluid communication with the wellbore line 425 and the discharge line 435. A line provides electrical/optical communication between the sensors 385*d-f* (and the choke valve 430) and the RCS. The data provided by the sensors 385*d-f* will allow the RCS to monitor pressure and temperature in the annulus 390 and the return lines 425, 435 to ensure that either within the hydrates drilling window DW or disassociating at a manageable rate.

Alternatively, the riser 310 may be added to the drilling system. In this alternative, the multiphase pump 420 could be disposed on the seafloor 320*f* or on the riser 310. Instead of the discharge line 435, the multiphase pump would discharge the returns 325*r* into the riser 310. Such a configuration is described and illustrated in U.S. Pat. No. 6,966,367, which is hereby incorporated by reference in its entirety. Further, any of the alternate downhole configurations illustrated in FIGS. 3C-3F may be used with the drilling system 400.

Figure 4A:
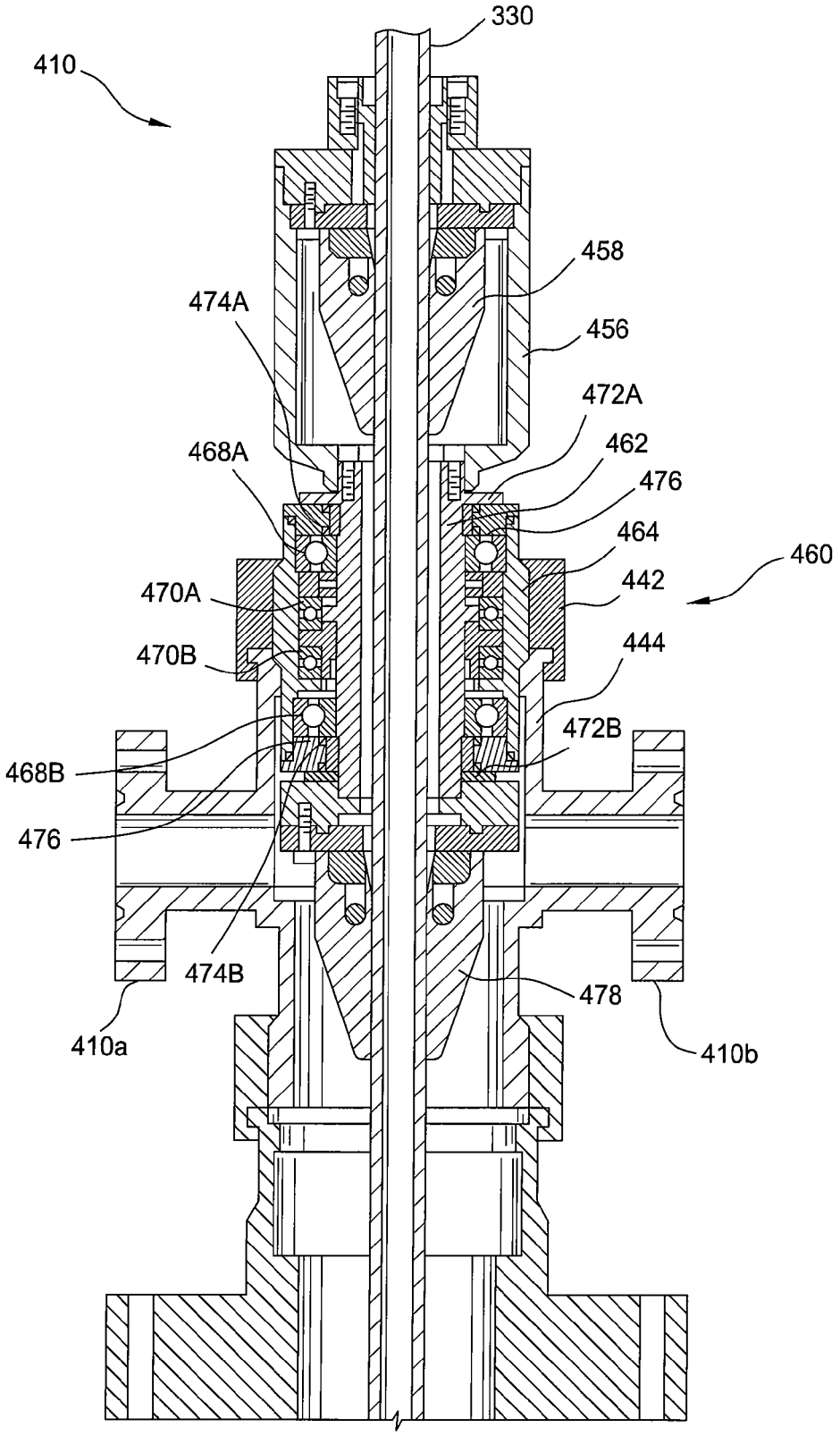
FIG. 4A is a section view of the RCD of FIG. 4.

FIG. 4A is a section view of the RCD 410 of FIG. 4. The RCD 410 includes a top rubber pot 456 containing a top stripper rubber 458. The top rubber pot 456 is mounted to a bearing assembly 460, having an inner member or barrel 462 and an outer barrel 464. The inner barrel 462 rotates with the top rubber pot 456 and its top stripper rubber 458 that seals with the drill string 330. A bottom stripper rubber 478 is also preferably attached to the inner barrel 462 to engage and rotate with the drill string 330. The inner barrel 462 and outer barrel 464 are received in a first opening of a housing 444. The outer barrel 464, clamped and locked to the housing 444 by clamp 442, remains stationary with the housing 444.

Radial bearings 468*a* and 468*b*, thrust bearings 470*a* and 470*b*, plates 472*a* and 472*b*, and seals 474*a* and 474*b* provide the sealed bearing assembly 460 into which lubricant can be injected into fissures 476 at the top and bottom of the bearing assembly 460 to thoroughly lubricate the internal sealing components of the bearing assembly 460. A self contained lubrication unit (not shown) provides subsea lubrication of the bearing assembly 460. The lubrication unit would be pressurized by a spring-loaded piston inside the unit and pushed through tubing and flow channels to the bearings 468*a*, 468*b* and 470*a*, 470*b*. Sufficient amount of lubricant would be contained in the unit to insure proper bearing lubrication of the RCD 410. The lubrication unit would preferably be mounted on the housing 444. The chamber on the spring side of the piston, which contains the lubricant forced into the bearing assembly 460, could be in communication with the housing 444 by means of a tube. This would assure that the force driving the piston is controlled by the spring, regardless of the water depth or internal well pressure. Alternately, the spring side of the piston could be vented to the sea 320.

Figure 5:
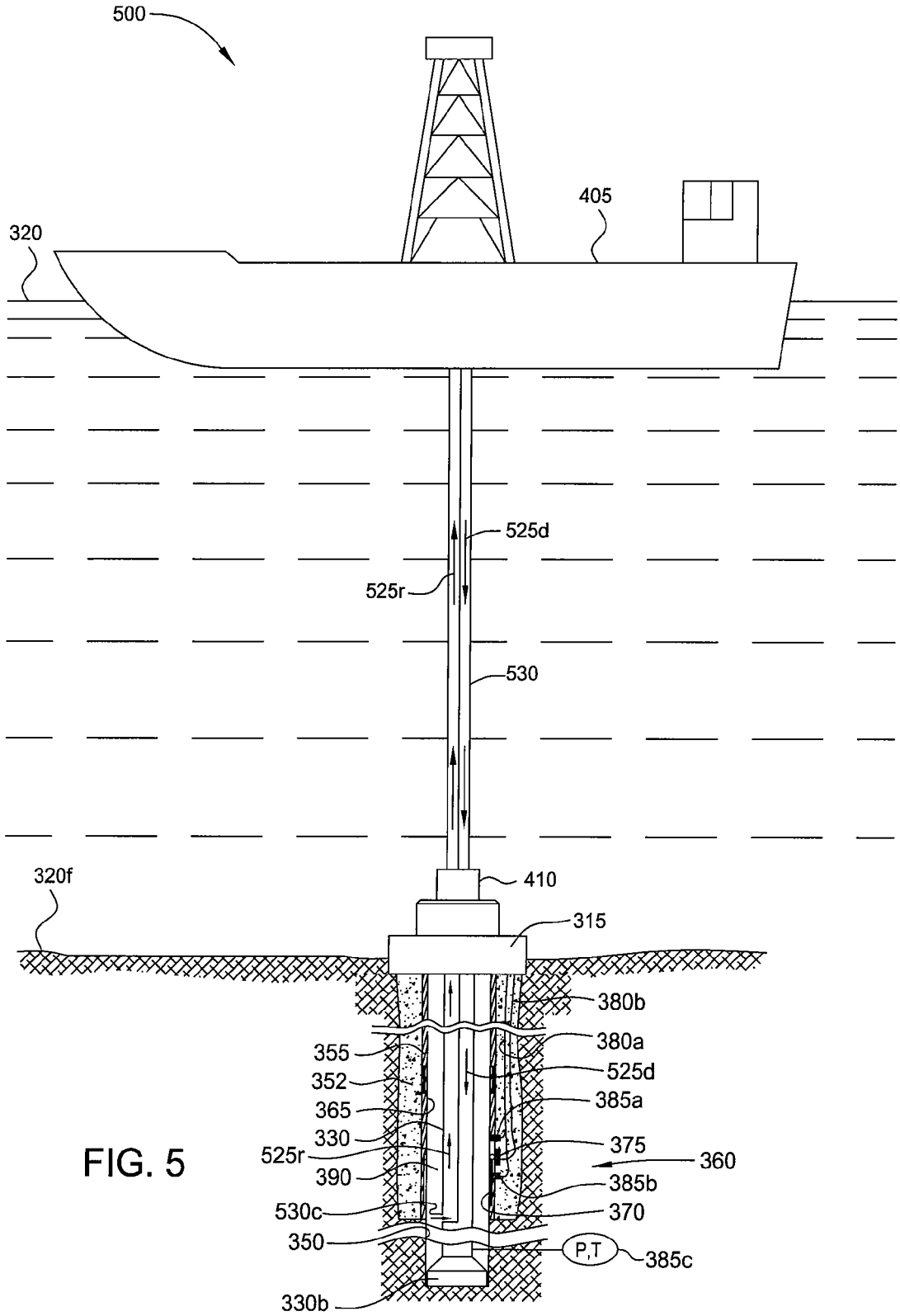
FIG. 5 illustrates an offshore drilling system, according to another embodiment of the present invention.

FIG. 5 illustrates an offshore drilling system 500, according to another embodiment of the present invention. Similar to the drilling system 400, the drilling system 500 is also riserless. However, instead of pumping the returns to the drill ship 405, a dual-flow drill string 530 is utilized. Alternatively, the multiphase pump 420 may be included to provide additional pressure control. Refrigerated drilling fluid 525*d* is injected into a second flow path 530*b* of the dual-flow drill string. The refrigerated drilling fluid 525*d* may be any of the drilling fluids 325*d* or coolants 325*c*, discussed above for the drilling system 300. The drilling fluid 525*d* travels through the second flow path until the dual flow drill string 530 transitions to a single flow BHA. The drilling fluid continues through the drill bit 330*b* and returns from the bit through the annulus. The returns 525*r* enter a first flow path 530*a* of the drill string 530 through a port 530*c* in fluid communication with the annulus 390. The returns travel through the first flow path 530*a* to the drill ship 405. The returns are isolated from the sea 320 by the RCD 410. Annulus pressure control is similar to the drilling system 300 and temperature control is provided by the controlling an injection temperature of the refrigerated drilling fluid 525*d* and/or the injection rate of the drilling fluid 525*d*. Alternatively, the drilling system 500 may be deployed for land-based operations in which case a land rig would be used instead.

As discussed earlier, the drilling fluid 525*d* may instead be heated to provide for controlled subsea and/or subsurface disassociation of the hydrates. Further, the drilling system 500 may also be implemented for tar sands and/or heavy crude oil formation in which the heated drilling fluid would be advantageous in reducing viscosity.

Figure 5A:
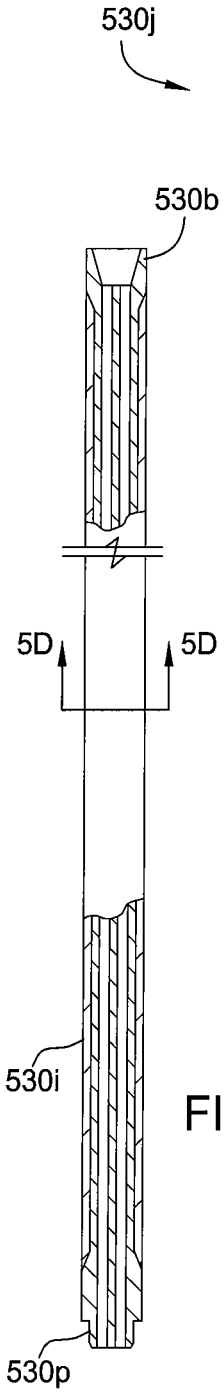
FIG. 5A is a partial cross section of a joint of the dual-flow drill string 530.
Figure 5C:
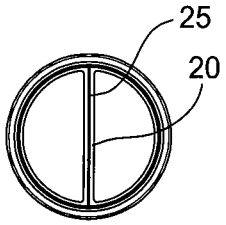
FIG. 5C is an enlarged top view of FIG. 5A.
Figure 5D:
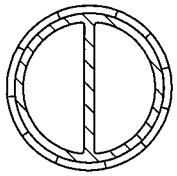
FIG. 5D is cross section taken along line 5D-5D of FIG. 5A.
Figure 5E:
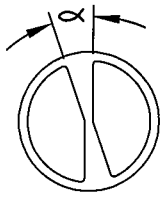
FIG. 5E is an enlarged bottom view of FIG. 5A.
Figure 5B:
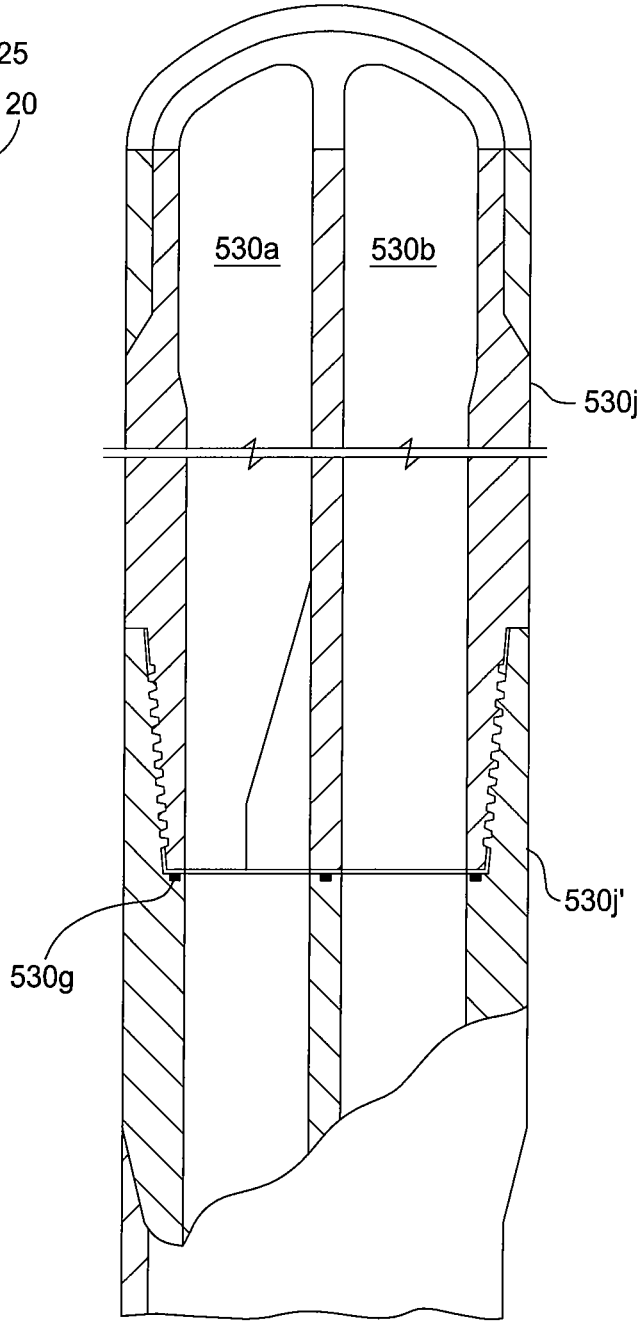
FIG. 5B is a cross section of a threaded coupling of the dual-flow drill string 530 illustrating the pin of the joint of FIG. 5 mated with a box of a second joint.

FIG. 5A is a partial cross section of a joint 530*j* of the dual-flow drill string 530. FIG. 5B is a cross section of a threaded coupling of the dual-flow drill string 530 illustrating a pin 530*p* of the joint 530*j* mated with a box 530*f* of a second joint 530*j*'. FIG. 5C is an enlarged top view of FIG. 5A. FIG. 5D is cross section taken along line 5D-5D of FIG. 5A. FIG. 5E is an enlarged bottom view of FIG. 5A. A partition is formed in a wall of the joint 530*j* and divides an interior of the drill string 530 into two flow paths 530*a* and 530*b*, respectively. A box 530*f* is provided at a first longitudinal end of the joint 530*j* and the pin 530*p* is provided at the second longitudinal end of the joint 530*j*.

A face of one of the pin 530*p* and box 530*f* (box as shown) has a groove formed therein which receives a gasket 530*g*. The face of one of the pin 530*p* and box 530*f* (pin as shown) may have an enlarged partition to ensure a seal over a certain angle $\alpha$. This angle $\alpha$ allows for some thread slippage. To minimize heat loss to the sea 320, a thermally insulating material 530*i* may be disposed along an outer surface of the dual-flow drill string 530. Alternatively, a concentric drill string may be used instead of the dual-flow drill string 530, similar to the concentric riser 310.

Figure 6:
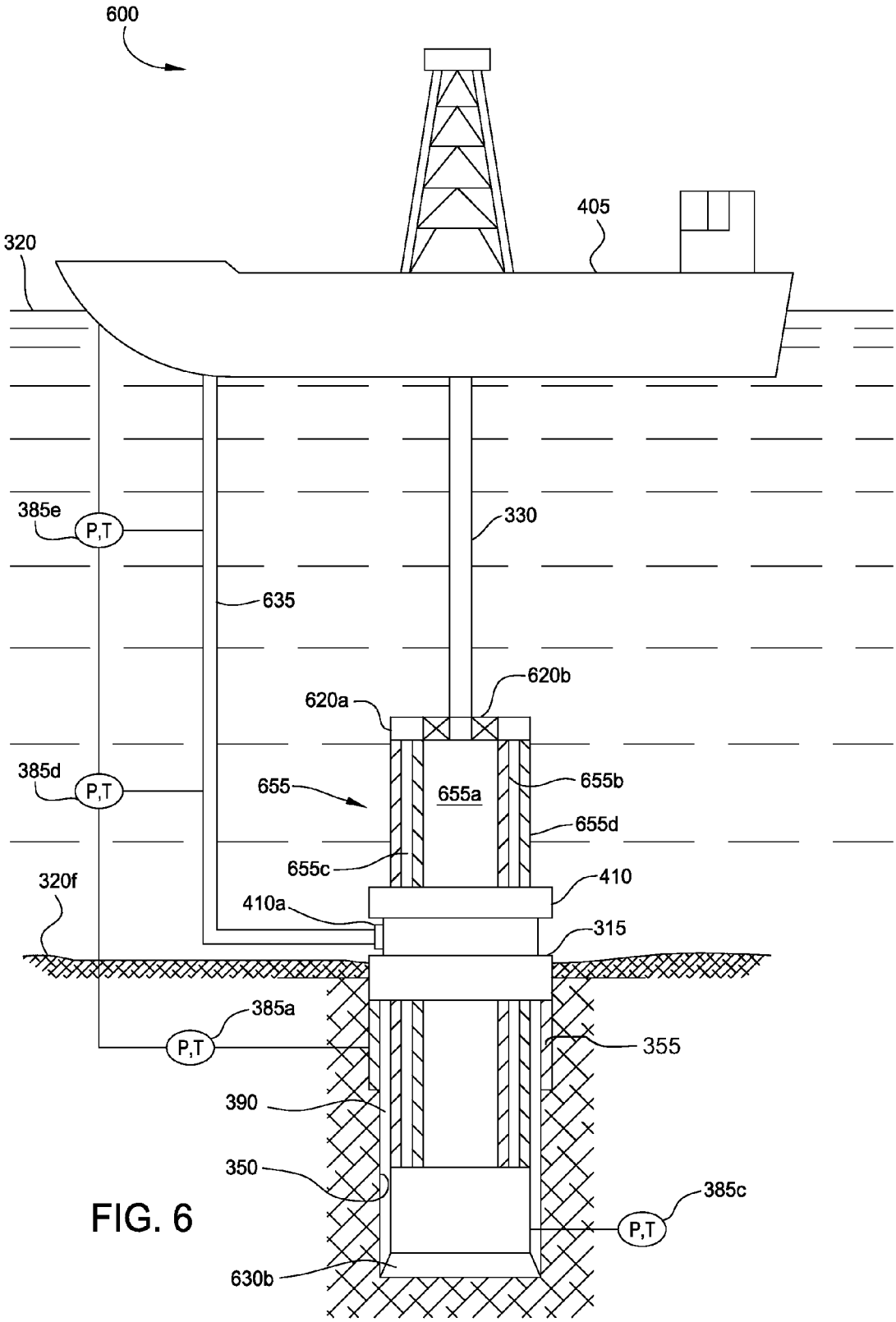
FIG. 6 illustrates an offshore drilling system, according to another embodiment of the present invention.

FIG. 6 illustrates an offshore drilling system 600, according to another embodiment of the present invention. Alternatively, the drilling system 600 may be deployed for land-based operations. A first casing string 355 and wellhead 315 have been drilled and set in the wellbore. As shown, the first casing string 355 is not cemented in the wellbore 350. Alternatively, the first casing string 355 may be cemented in the wellbore 350. As shown, the first casing string 355 does not include a DDV 360. Alternatively, the first casing string 355 may include a DDV 360. The RCD 410 is installed on the wellhead 315. A second casing string 655 having a drill bit 630*b* disposed on a second longitudinal end thereof is being used to extend the wellbore 350. The drill bit 630*b* may be conventional, drillable, or retrievable by being latched to the second end of the second casing.

The second casing string 655 is a concentric casing string, similar to the riser 330 having a bore 655*a*, an inner tubular 655*b*, an annulus 655*c*, and an outer tubular 655*d*. Alternatively, the second casing 655 string may be a conventional casing string. The second casing string bore is in fluid communication with the drill string 330 and the drill bit 630*b*. A casing head 620*a* is attached to the first longitudinal end of the second casing string 655. The casing head 620*a* is attached to the drill string 330 by a hanger/packer 620*b*. Alternatively, if the sea depth is less than or equal to a length that the wellbore will be extended, then the drill string 330 is not used. The hanger/packer 620*b* seals an interface of the drill string 330 and the second casing string 655 from the sea 320. A return line 635 provides fluid communication with the outlet 410*a* of the RCD 410 and the drill ship 405. The return line 635 may be thermally insulated.

Drilling may be accomplished by rotating the drill string and second casing string and/or by a mud motor disposed between the drill bit and the second casing string (in which case the drill string may be coiled tubing). Refrigerated drilling fluid 525*d* is injected into the drill string 330 and travels therethrough and through the bore of the second casing string to the drill bit 630*b*. The returns 525*r* travel from the bit 630*b* through the annulus 390 and are diverted into the return line 635 by the RCD 410. The returns 525*r* travel through the return line to the drill ship 405. Temperature and pressure control are similar to the drilling system 500. Once the casing head 620*a* is seated in the wellhead 310, the second casing string may be cemented in the wellbore using the drill string 330. After the cementing operation, the anchor/packer 620*b* may be released and the drill string 330 may be retrieved to the drill ship. The wellbore may be completed by perforating the casing and/or drilling and lining one or more lateral wellbores into the hydrates formation (see FIGS. 11A-D) and running production tubing. The drill ship may then be replaced by a production platform (not shown)

The second casing string 655 includes a first port in fluid communication with the annulus 655*c* and the return line 635 in or near the casing head and a second port near the drill bit in fluid communication with the bore. The ports are sealed by a frangible member, such as a rupture disk. The rupture disks may be fractured, thereby exposing the ports and providing a fluid communication path from the bore 655*a* through the annulus 655*c*. To produce from the hydrates formation, a disassociation fluid may be injected through the return line from the production platform to cause disassociation of the hydrates in the formation. The disassociation fluid may be any of the antifreezes discussed for the drilling system 300, an alcohol, saltwater, or water. The disassociation fluid may be at ambient temperature or may be heated on the production platform. Alternatively, the disassociation fluid may be a heated gas, such as steam or natural gas. The resulting gas (and water) would flow through the production tubing to the production platform.

The ability to inject heated fluid into the second casing string 655 would also be advantageous in producing from tar sands and/or heavy crude oil formations and would provide control over the viscosity for production.

In an alternate aspect of the drilling system 600, the drill string 330 may be replaced by the dual-flow drill string 530. In this alternative, the return line 635 may be omitted. The second flow path of the drill string would be in fluid communication with the second casing string bore. The second casing string bore would also in fluid communication with the drill bit 630*b*. The second casing string annulus would be in fluid communication with the wellbore annulus 390 and the first flow path 530*a* of the drill string via the hanger/packer 620*b*. Refrigerated drilling fluid would be injected into the second flow path of the drill string and flow through the second casing string bore. Returns would enter the second casing string annulus and travel to the surface via the first drill string flow path.

In another alternate aspect of the drilling system 600, the drill string 330 may be replaced by the dual-flow drill string 530. The second flow path of the drill string would be in fluid communication with the second casing string bore. The second casing string annulus still be sealed by the rupture disks but upon fracture fluid communication would be provided between the second casing string annulus and the first flow path of the dual-flow drill string. Refrigerated drilling fluid would be injected into the second flow path of the drill string and flow through the second casing string bore. In normal operation, returns would flow through the wellbore annulus and into the return line. However, in the event that temperature or pressure control is lost, a refrigerated kill fluid, such as liquid nitrogen or antifreeze, would be maintained on the drill ship 600 and would be injected under pressure sufficient to fracture the rupture disks, thereby restoring well control until normal drilling operations could be resumed.

Figure 7:
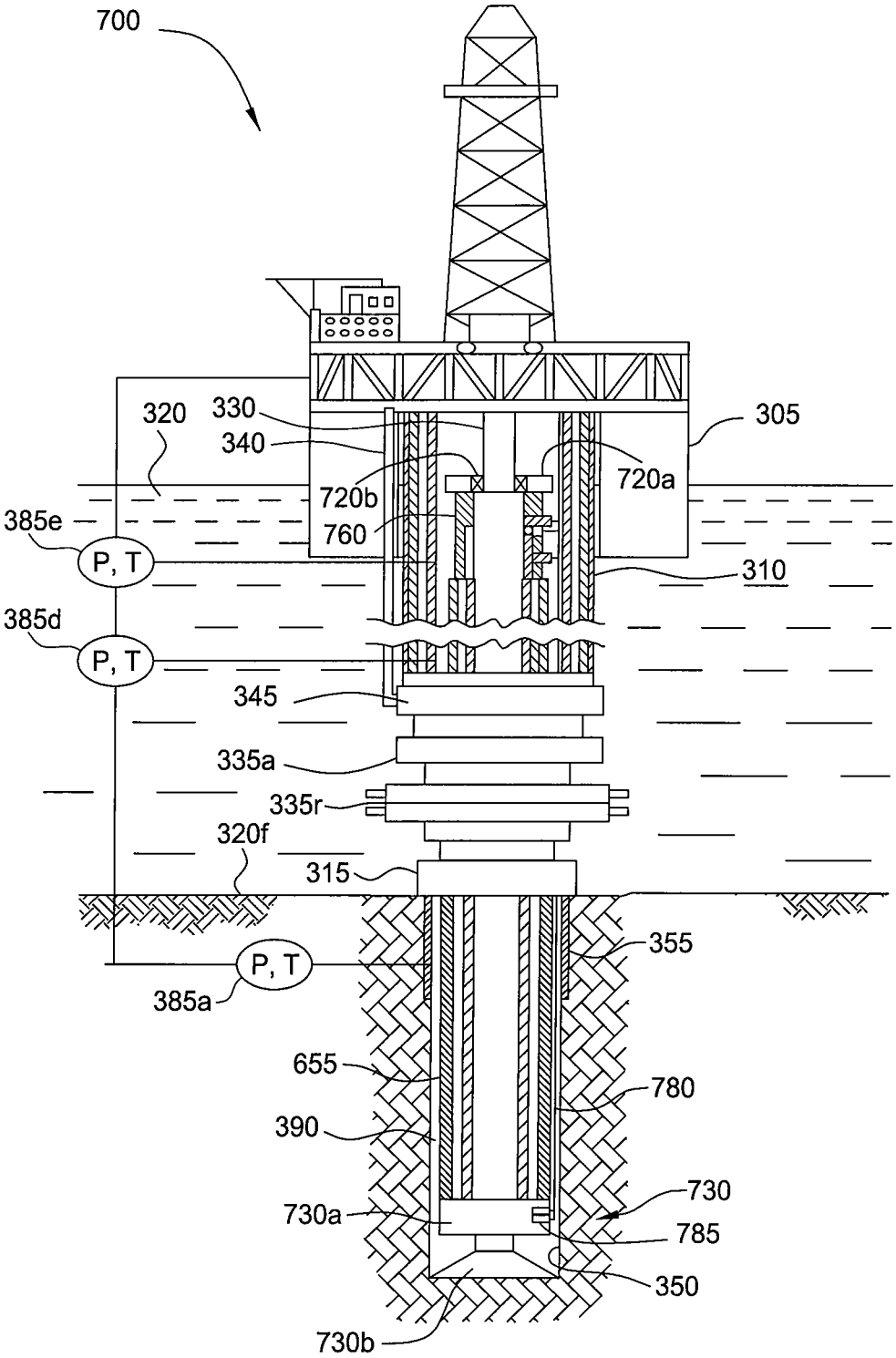
FIG. 7 illustrates an offshore drilling system, according to another embodiment of the present invention.

FIG. 7 illustrates an offshore drilling system 700, according to another embodiment of the present invention. Similar to the drilling system 600, the drilling system 700 is a drilling with casing drilling system. However, the drilling system 600 is different from the drilling system 600 in that it includes a concentric riser 310, similar to the drilling system 300. The second casing string 655 having a BHA 730 disposed on a second longitudinal end thereof is being used to extend the wellbore 350. The BHA 730 includes a mud motor 730*a*, a drill bit 730*b* attached to an output shaft of the mud motor 730*a*, and a PT sensor 785 in fluid communication with the wellbore annulus 390 and/or the bore of the second casing string. The BHA 730 may be conventional, drillable, or retrievable by being latched to the second end of the second casing string (if removable, the PT sensor may be located in a separate, non-removable instrumentation sub). A line 780 extending from the PT sensor 785 along an outer surface of the second casing 655 provides electrical/optical communication between the PT sensor 785 and the RCS on the floating vessel 305. Disposed between the casing head 620*a* and the second casing 655 is a DDV 760. The DDV 760 may be similar to the DDV 360 except that the housing includes one or more channels formed longitudinally therethrough in fluid communication with the second casing annulus 655*c*. In this manner, fluid communication between the second casing annulus and the port in or near the casing head is maintained. Alternatively, If, as discussed earlier, the casing string 655 is a conventional casing string, then the DDV 360 may be used instead of the DDV 760. The DDV sensors connect to line 780. The line 780 may also include a hydraulic line connected to the DDV actuator.

Injection of the drilling fluid 525*d* is similar to the drilling system 600 with the exception that either the drilling fluid 325*d* or the refrigerated drilling fluid 525*d* may be used. The returns travel through the annulus 390 and into and through the inner annulus 330*a* of the riser to the floating vessel 305. Operation of the riser coolant is similar to the drilling system 300. Cementing of the second casing string, removal of the drill string, and installation of production tubing are similar to the drilling system 600 except for the additional installation of the return line 635 and the return line may be connected to the wellhead 315 instead of the RCD 410 which is not required in this system 700. Alternatively, the drilling system 700 may be deployed for land-based operations.

Figure 8A:
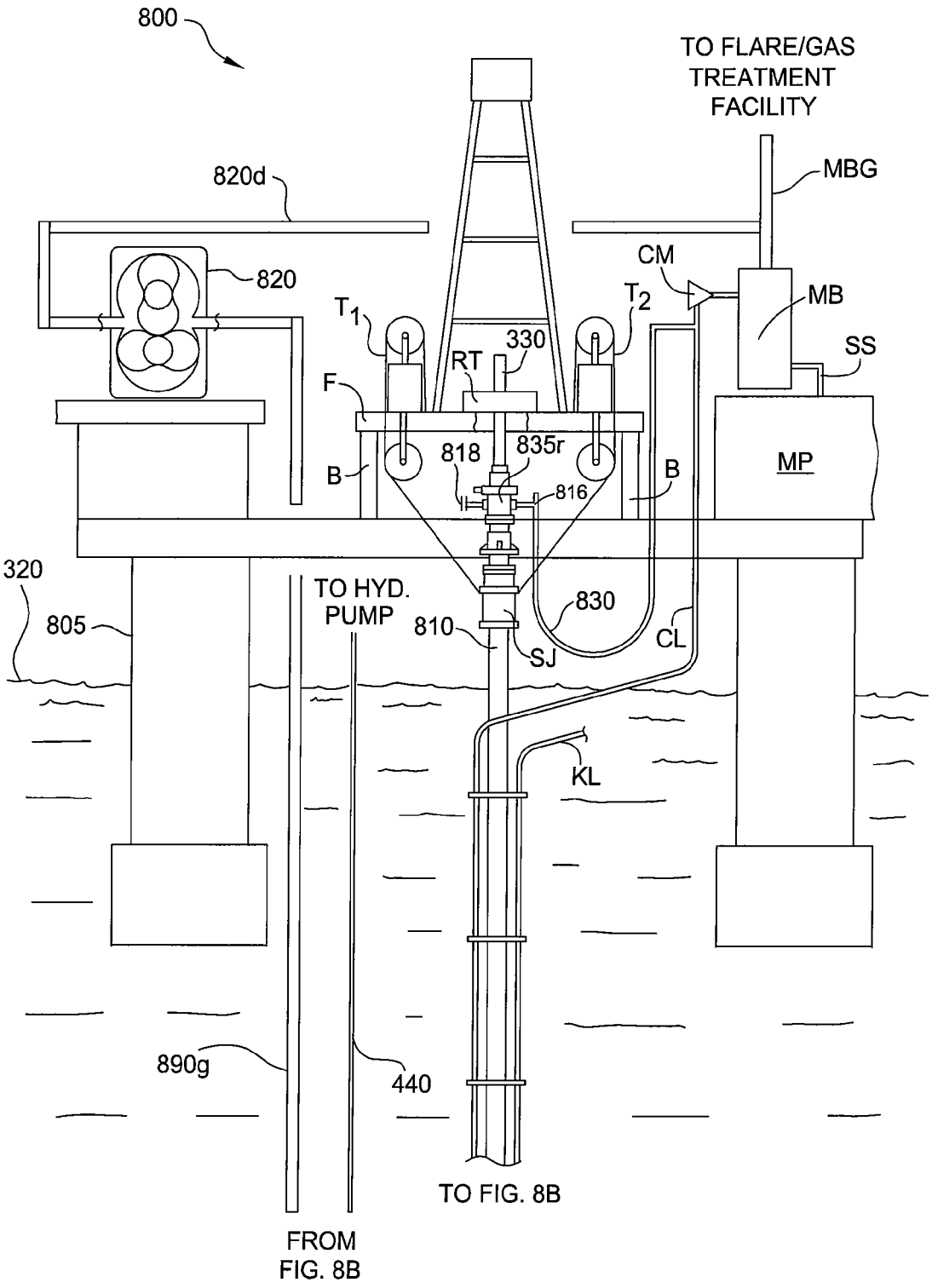
FIGS. 8A and 8B illustrate an offshore drilling system, according to another embodiment of the present invention.
Figure 8B:
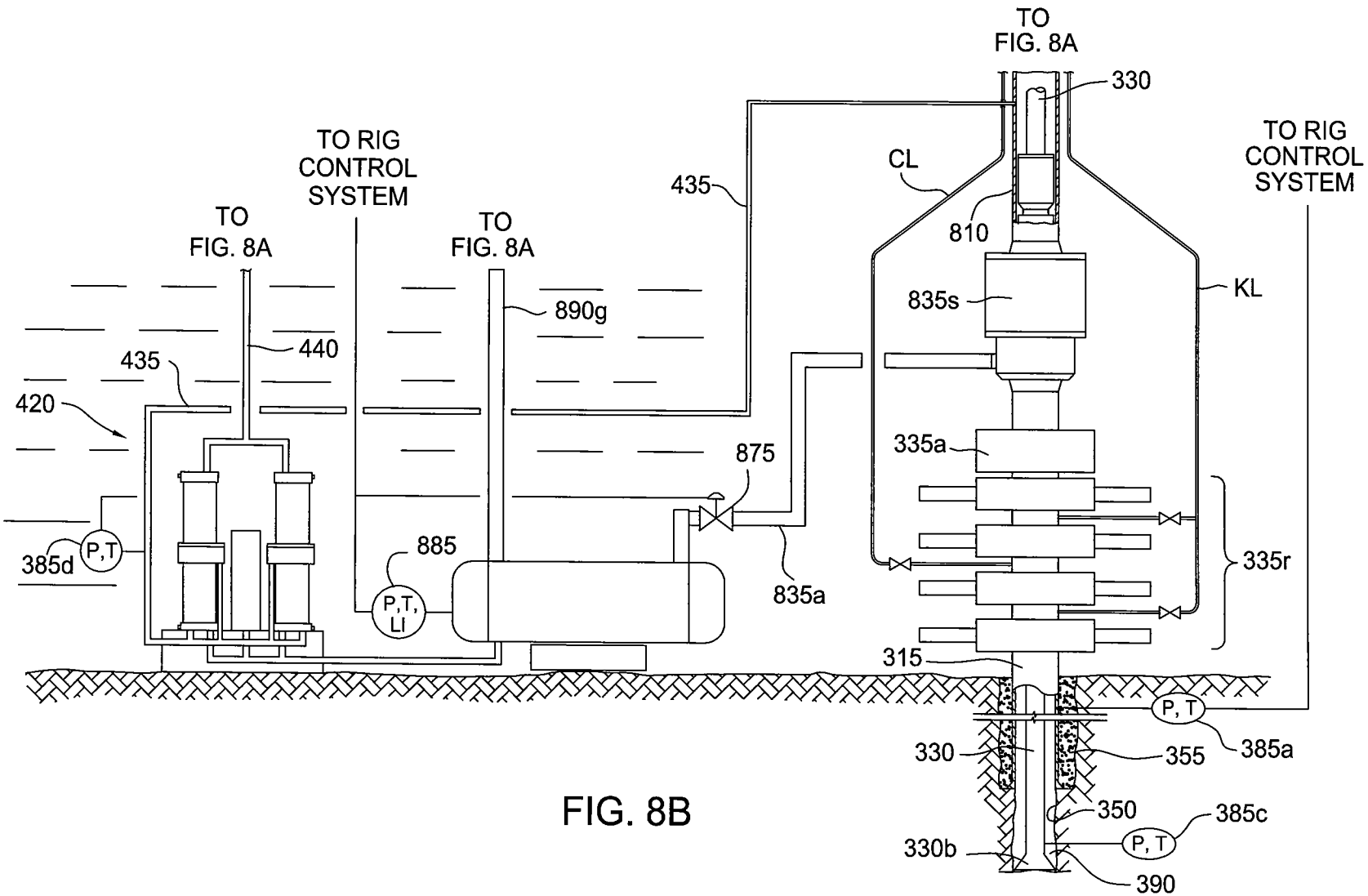

FIGS. 8A and 8B illustrate an offshore drilling system 800, according to another embodiment of the present invention. A riser 810 is connected between a floating vessel 805 and the wellhead 315. Alternatively, the concentric riser 310 may be used instead of the riser 810. Vertical rotary beams B are disposed between two levels of the rig and support a rotary table RT. A choke line CL and kill line KL, are run along an outer surface of the riser 810. A conventional flexible choke line CL has been configured to communicate with a choke manifold CM. The drilling fluid then can flow from the manifold CM to a separator MB and a flare/gas treatment facility line. The drilling fluid can then be discharged to a shale shaker SS to mud pits and pumps MP. An example of some of the flexible conduits now being used with floating rigs are cement lines, vibrator lines, choke and kill lines, test lines, rotary lines and acid lines.

An RCD 835*r* is attached above the riser 810. The slip joint SJ is locked into place, so that there is no relative vertical movement between the inner barrel and outer barrel of the slip joint SJ. Alternatively, the slip joint SJ may be removed from the riser 810 and the RCD 835*r* attached directly to the riser 810. An adapter may be positioned between the RCD 835*r* and the slip joint SJ. Tensioners T1 and T2 apply tension to the riser 810. The drill string 330 is positioned through the rotary table RT, through the rig floor F, through the RCD 835*r* and into the riser 810. Outlets 816 and 818 extend radially outwardly from the side the RCD 835*r*. Additionally, remotely operable valves 122, 126 and manual valves 124, 128 (see FIG. 8C) are provided with respective connectors 816, 818 for closing the connectors to shut off the flow of fluid, when desired. A conduit 830 is connected to the outlet 816 of the RCD 835*r* for communicating the returns to the choke manifold CM. Similarly, a conduit could be attached to connector 818 (shown capped), to discharge to the choke manifold CM or directly to a separator MB or shale shaker SS. Conduit 830 may be a elastomer hose; a rubber hose reinforced with steel; a flexible steel pipe or other flexible conduit.

A first casing string 355 and wellhead 315 have been drilled and set in the wellbore 350. As shown, the first casing string 355 is cemented in the wellbore 350. Alternatively, the first casing string 355 may not be cemented in the wellbore 350. As shown, the first casing string 355 does not include the DDV 360. Alternatively, the first casing string 355 may include the DDV 360. Refrigerated drilling fluid 525*d* is injected through the drill string 330. The returns 525*r* travel through the annulus and the wellhead 315 where they are diverted by an internal riser RCD (IRCH) 835*s* is attached to the wellhead 315. The returns 835*s* are diverted into a line 835*a* in fluid communication with an outlet of the IRCH 835*s* and an inlet of a separator 890. A variable choke valve 875 may be installed in the line 835*a* to provide additional pressure control over the annulus 390. The returns are transported into the separator 890. The separator 890 allows for controlled subsurface disassociation of hydrates in the returns 525*r* from the annulus. The separator 890 is shown as a horizontal separator. Alternatively, the separator 890 may be a vertical or spherical separator. A cuttings and liquid line 8901 is in fluid communication with a cuttings and liquid outlet of the separator and an inlet of the multiphase pump 420. A gas line 835*g* is in fluid communication with a gas outlet of the separator 890 and an inlet of an optional vacuum pump 820 on the floating platform 805. The vacuum pump 820 provides additional control over the pressure in the separator 890 to control the disassociation of the hydrates. Solid hydrates will not travel in the liquid and cuttings line 8901 because the hydrates will float in a drilling fluid 525*d* level maintained in the separator 890. Liquid and rock cuttings discharged from the multiphase pump 420 travel through the line 435 and are returned to the riser 810 at an inlet above the IRCH 835*s*. The liquid and rock cuttings then travel to the floating vessel where they are diverted by RCD 835*r*, into outlet 816, through conduit 830, through the choke manifold CM, and into the separator MB. Gas discharged from the vacuum pump travels through a discharge line and meets a gas discharge line MBG from the vessel separator MB for transport to a flare or gas treatment facility. PT sensors 385*a, c, d* provide monitoring capability for the RCS as well as PT sensor and liquid level indicator 885 which is in fluid communication with the returns 525*r* in an interior of the separator 890.

Additionally, a heating coil may be included around or within the separator 890 to provide additional control over disassociation of the hydrates. Instead of a heating coil, heated seawater may be pumped from the floating platform 805 into tubing around or within the separator 890. Alternatively, a bypass line (not shown) may connect from a second outlet (not shown) of the IRCH 835*s* and into a second riser inlet (not shown) and have an automatic gate valve in communication with the RCS to provide an option to return to a drilling mode which discourages disassociation in the event of equipment failure or unstable disassociation.

Alternatively, instead of the separator 890, the multiphase pump 420 may be configured for gas separation. Such a configuration is described and illustrated in FIGS. 7-11 of the '367 patent (discussed and incorporated above). Briefly, in one configuration, an enlarged inlet chamber is provided for each of the plunger assemblies. The returns are directed tangentially into the enlarged chamber to create a centrifugal force, thereby promoting gas separation. One or more gas outlet lines are provided in each of the plunger assemblies. In another configuration, an annulus is added to the first configuration between each plunger and a respective plunger chamber to permit gas to fill the annulus, thereby pressurizing the gas during pumping. In another alternative configuration, a bore is provided through each of the plungers and connected to a separate gas outlet. A deflector plate is provided in an enlarged inlet chamber of each of the plunger assemblies to promote separation. The gas escapes through the bores and into the gas outlet.

Figure 8C:
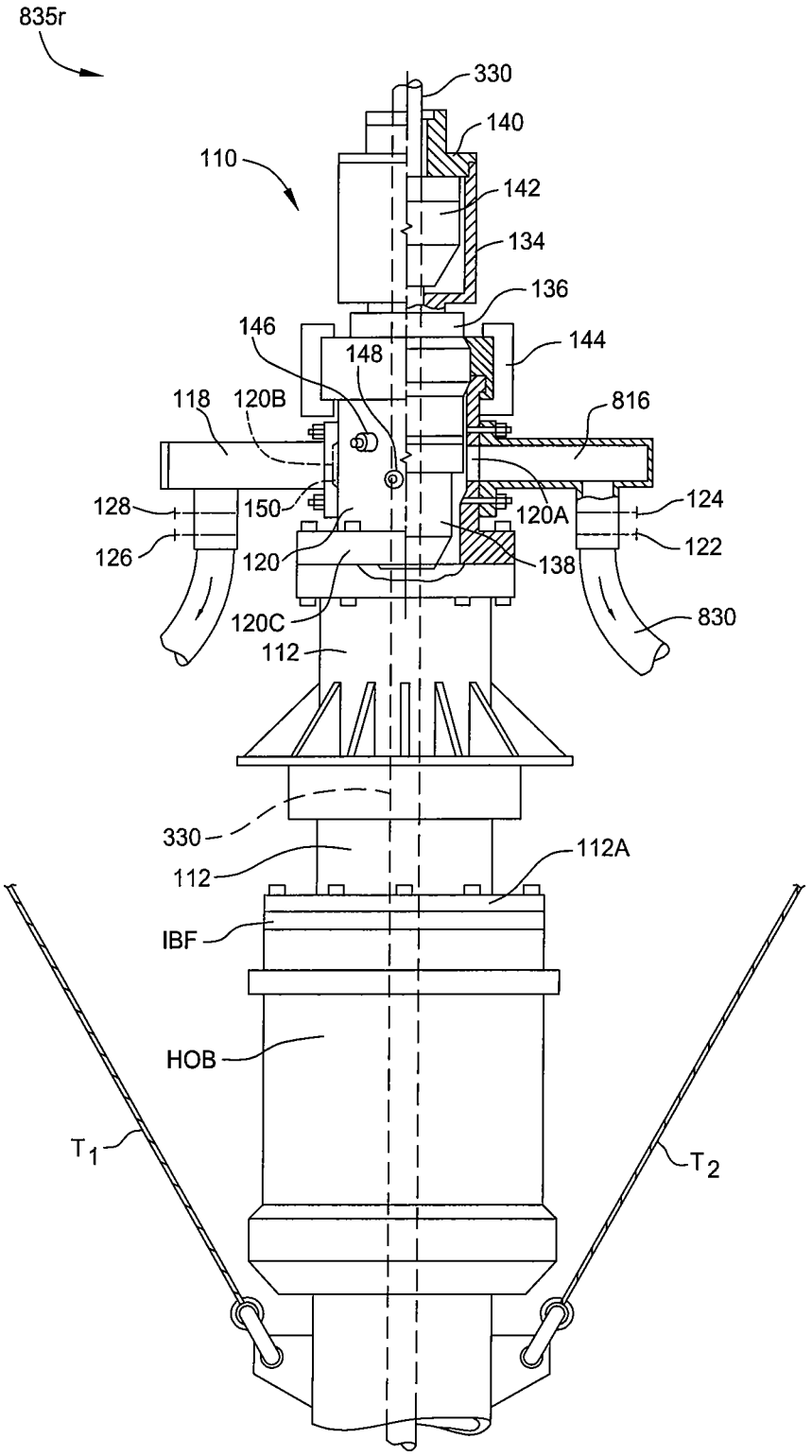
FIG. 8C is a detailed view of the RCD of FIG. 8A.

FIG. 8C is a detailed view of the RCD 835*r*. The RCD 835*r* includes a bearing and seal assembly 110 which includes a top rubber pot 134 connected to the bearing assembly 136, which is in turn connected to the bottom stripper rubber 138. The top housing 140 above the top stripper rubber 142 is also a component of the bearing and seal assembly 110. Additionally, a quick disconnect/connect clamp 144, is provided for connecting the bearing and seal assembly 110 to the seal housing or bowl 120. When the drill string 330 is tripped out of the RCD 835*r*, the clamp 144 can be quickly disengaged to allow removal of the bearing and seal assembly 110.

The housing or bowl 120 includes first and second housing openings 120*a, b* opening to their respective outlet 816, 818. The housing 120 further includes holes 146, 148 for receiving locking pins and locating pins. The seal housing 120 is preferably attached to an adapter or crossover 112. The adapter 112 is connected between the seal housing flange 120C and the top of the inner barrel of the slip joint SJ. When using the RCD 835*r* movement of the inner barrel of the slip joint SJ is locked with respect to the outer barrel and the inner barrel flange IBF is connected to the adapter bottom flange 112A. In other words, the head of the outer barrel HOB, that contains the seal between the inner barrel and the outer barrel, stays fixed relative to the adapter 112.

Figure 8D:
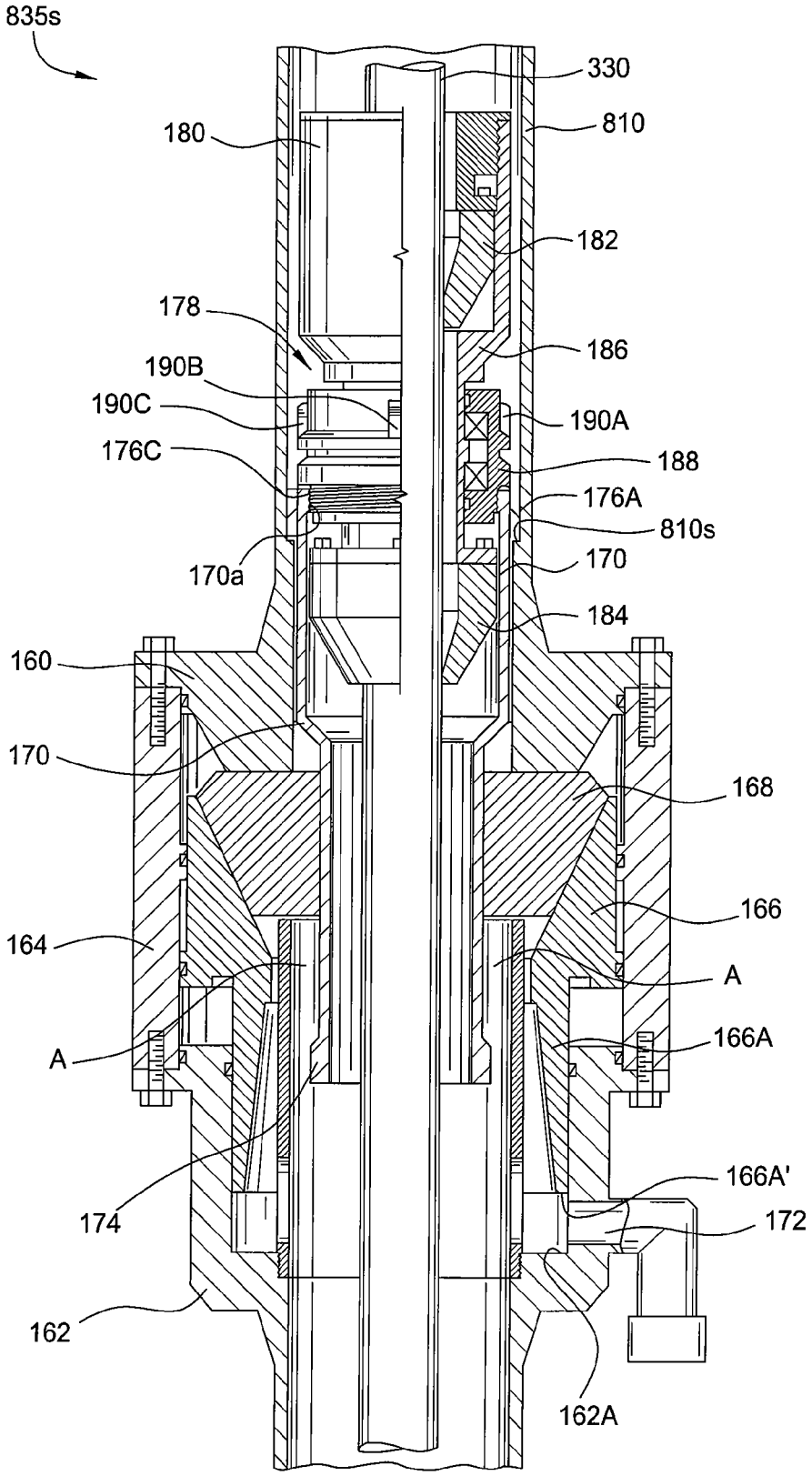
FIG. 8D is a detailed view of the IRCH of FIG. 8B.

FIG. 8D is a detailed view of one embodiment of the IRCH 835*s*. IRCH 835*s* includes an upper head 160 and a lower body 162 with an outer body or first housing 164 therebetween. A piston 166 having a lower wall 166*a* moves relative to the first housing 164 between a sealed position and an open position, where the piston 166 moves downwardly until the end 166*a*' engages the shoulder 162*a*. In this open position, the annular packing unit or seal 168 is disengaged from the internal housing 170 while the wall 166*a* blocks the discharge outlet 172. The internal housing 170 includes a continuous radially outwardly extending upset or holding member 174 proximate to one end of the internal housing 170. When the seal 168 is in the open position, it also provides clearance with the holding member 174. The upset 174 is preferably fluted with one or more bores to reduce hydraulic pistoning of the internal housing 170. The other end of the internal housing 170 preferably includes threads 170*a*. The internal housing includes two or more equidistantly spaced lugs 176*a, c*.

The bearing assembly 178 includes a top rubber pot 180 that is sized to receive a top stripper rubber or inner member seal 182. Preferably, a bottom stripper rubber or inner member seal 184 is connected with the top seal 182 by the inner member 186 of the bearing assembly 178. The outer member 188 of the bearing assembly 178 is rotatably connected with the inner member 186. The outer member 188 includes two or more equidistantly spaced lugs 190*a-c*. The outer member 188 also includes outwardly-facing threads 188*a* corresponding to the inwardly-facing threads 170*a* of the internal housing 170 to provide a threaded connection between the bearing assembly 178 and the internal housing 170.

Three purposes are served by the two sets of lugs 190*a-d* and 176*a-d*. First, both sets of lugs serve as guide/wear shoes when lowering and retrieving the threadedly connected bearing assembly 178 and internal housing 190, both sets of lugs also serve as a tool backup for screwing the bearing assembly 178 and housing 190 on and off, lastly, the lugs 176*a-d* on the internal housing 170 engage a shoulder 810*s* on the riser 810 to block further downward movement of the internal housing 170, and, therefore, the bearing assembly 178. The drill string 330 can be received through the bearing assembly 178 so that both inner member seals 182 and 184 engage the drill string 330. Secondly, the annulus A between the first housing 164 and the riser 810 and the internal housing 170 is sealed using seal 168. These above two seals provide a desired barrier or seal in the riser 810 both when the drill string 330 is at rest or while rotating.

Figure 9A:
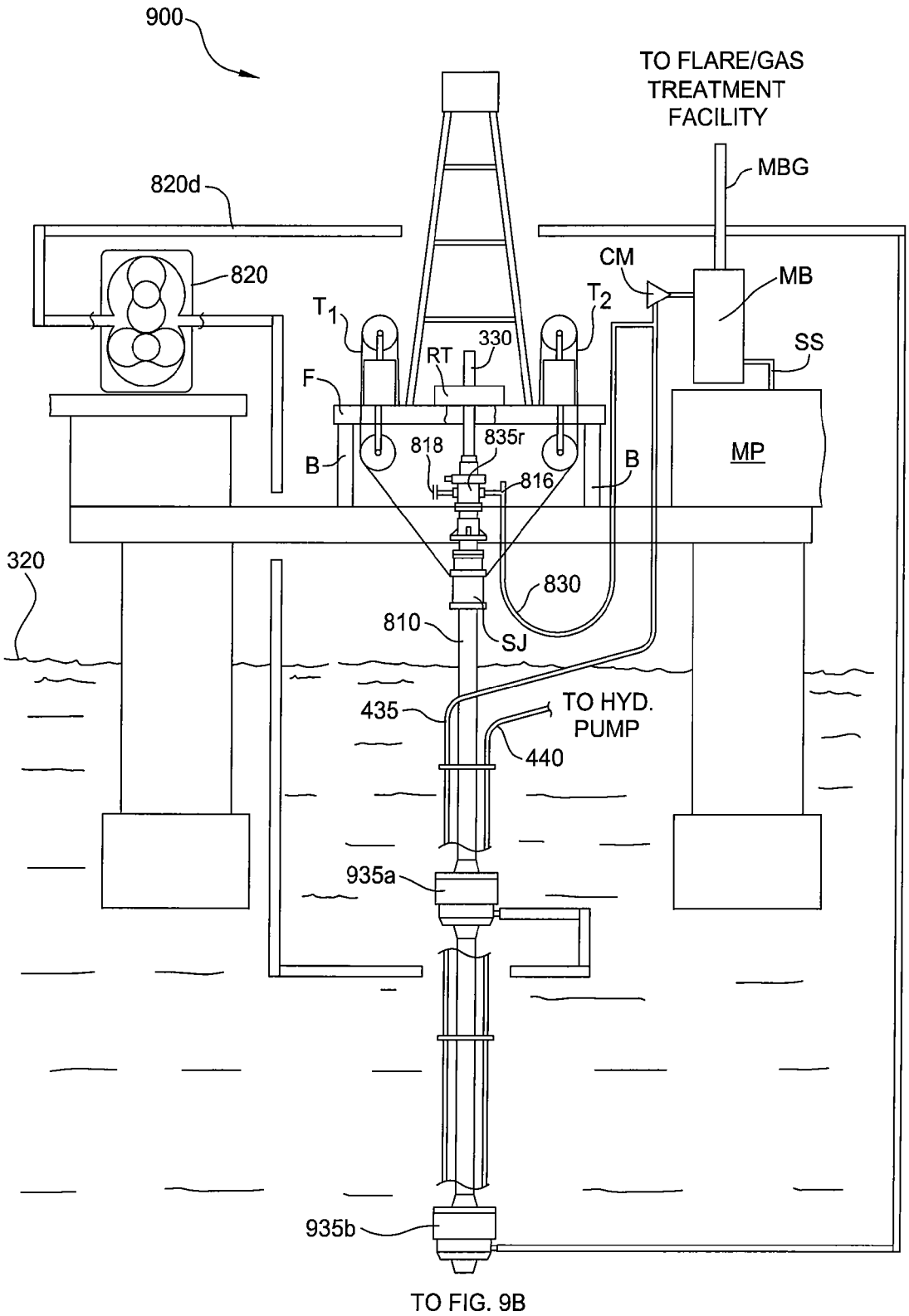
FIGS. 9A and 9B illustrate an offshore drilling system, according to another embodiment of the present invention.
Figure 9B:
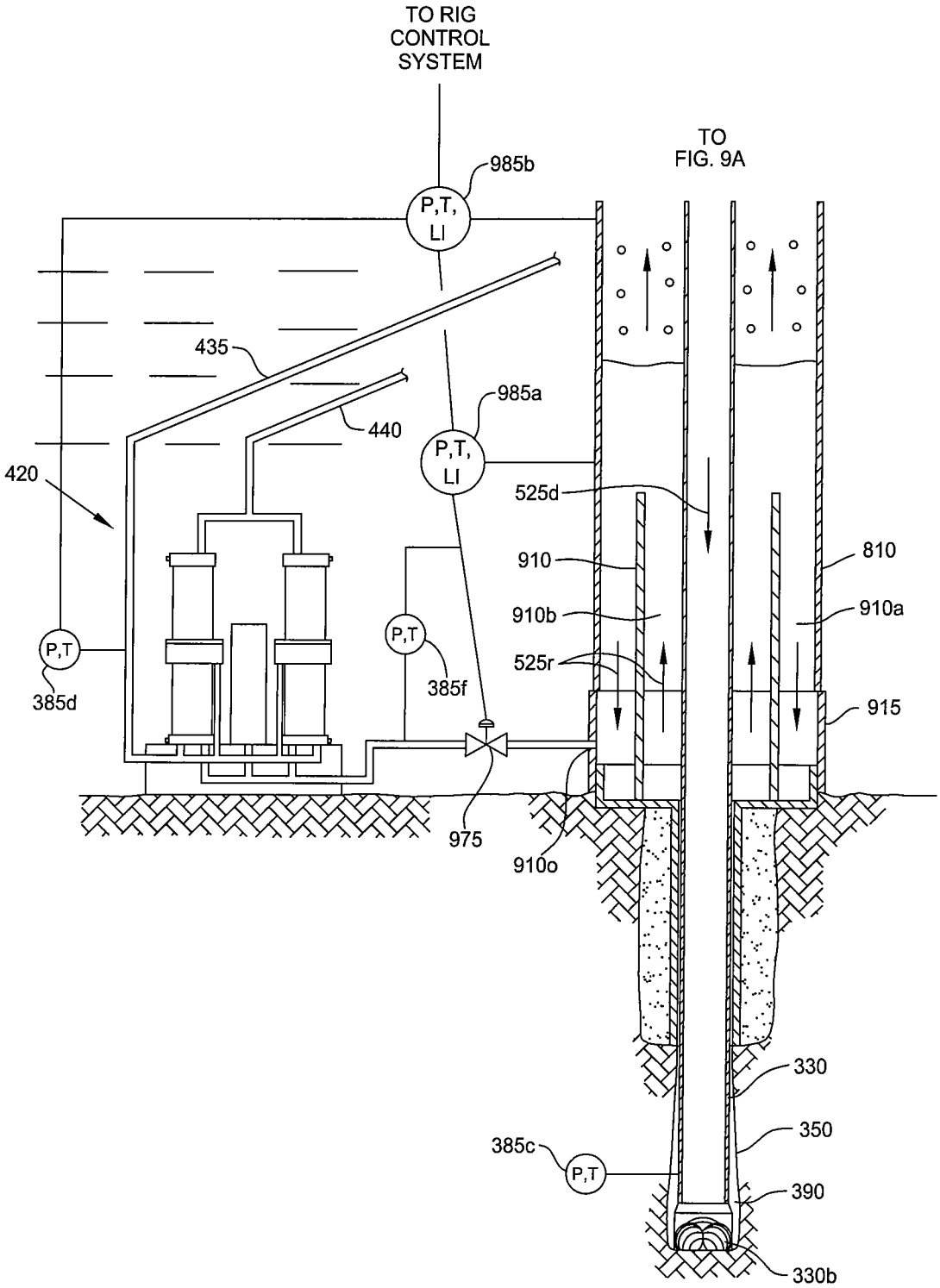

FIGS. 9A and 9B illustrate an offshore drilling system 900, according to another embodiment of the present invention. Similar to the drilling system 800, the drilling system 900 also provides for subsea disassociation of the hydrates. However, instead of using the separator 890, the drilling system 900 uses the riser 810 itself as a separator. Further, the drilling system 900 provides an option of returning to a more conventional drilling method if control of the subsea disassociation becomes unstable. Instead of the IRCH 835*s*, a baffle or weir 910 is installed in the wellhead 915. Although the BOPs 335*a, r* are not shown in FIG. 9B, they may be provided on the wellhead 915 below the weir 910. The weir 910 divides a lower portion of the riser into an inner annulus 910*b* and an outer annulus 910*a*. Returns 525*r* from the wellbore annulus 390 travel into the inner annulus 910*b*. An outlet line 9100 is in fluid communication with the outer annulus 910*a* and an inlet of the multiphase pump 420. The reversal of flow of the returns 525*r* over the weir 910 allows any disassociated gas and solid hydrates to separate from the liquid and solids in the returns 525*r* and remain in the riser 810. The separated liquids and solids are discharged by the pump 420 to through the line 435 to the choke manifold CM or directly to the separator MB. The separated hydrates solids are allowed to disassociate in the riser 810 and the gas travels through the riser 810 to the RCD 835*r* where it is diverted via the outlet 816 into the conduit 830 to the choke manifold CM, the separator MB, or the gas outlet line MBG. Optionally disposed along the riser 810 are one or more BOPs, such as gas handlers 935*a, b*. The gas handlers 935*a, b* are selectively actuatable to sealingly engage the drill string 330 and divert the gas in the riser 810 to an outlet. The outlets of the gas handlers may be connected to either the vacuum pump 820 or the gas line MBG. In normal operation, the gas handlers 935*a, b* are disengaged from the drill string allowing the gas to flow through the riser 810 to the floating vessel 805. If disassociation should become unstable, one of the gas handlers 935*a, b* would be actuated by a hydraulic line (not shown) to seal the drill string and divert the gas to either the vacuum pump or the gas line MBG.

To aid the disassociation process, a disassociation fluid may be injected into the riser via a line (not shown, see FIG. 10) from the vessel 805. The disassociation fluid may be any of the antifreezes discussed for the drilling system 300, an alcohol, saltwater, or water. The disassociation fluid may be at ambient temperature or may be heated on the vessel 805. Alternatively, the disassociation fluid may be a heated gas, such as steam or natural gas.

If it is desirable to return to a drilling operation in which disassociation is discouraged, a remotely actuated gate valve 975 in the riser outlet line 910*o* would be closed. All of the returns 525*r* would then travel from the wellbore annulus 390 via the riser 810 to the RCD 835*r*. The returns would continue through the conduit 830 to the choke manifold CM and into the separator MB.

Figure 9C:
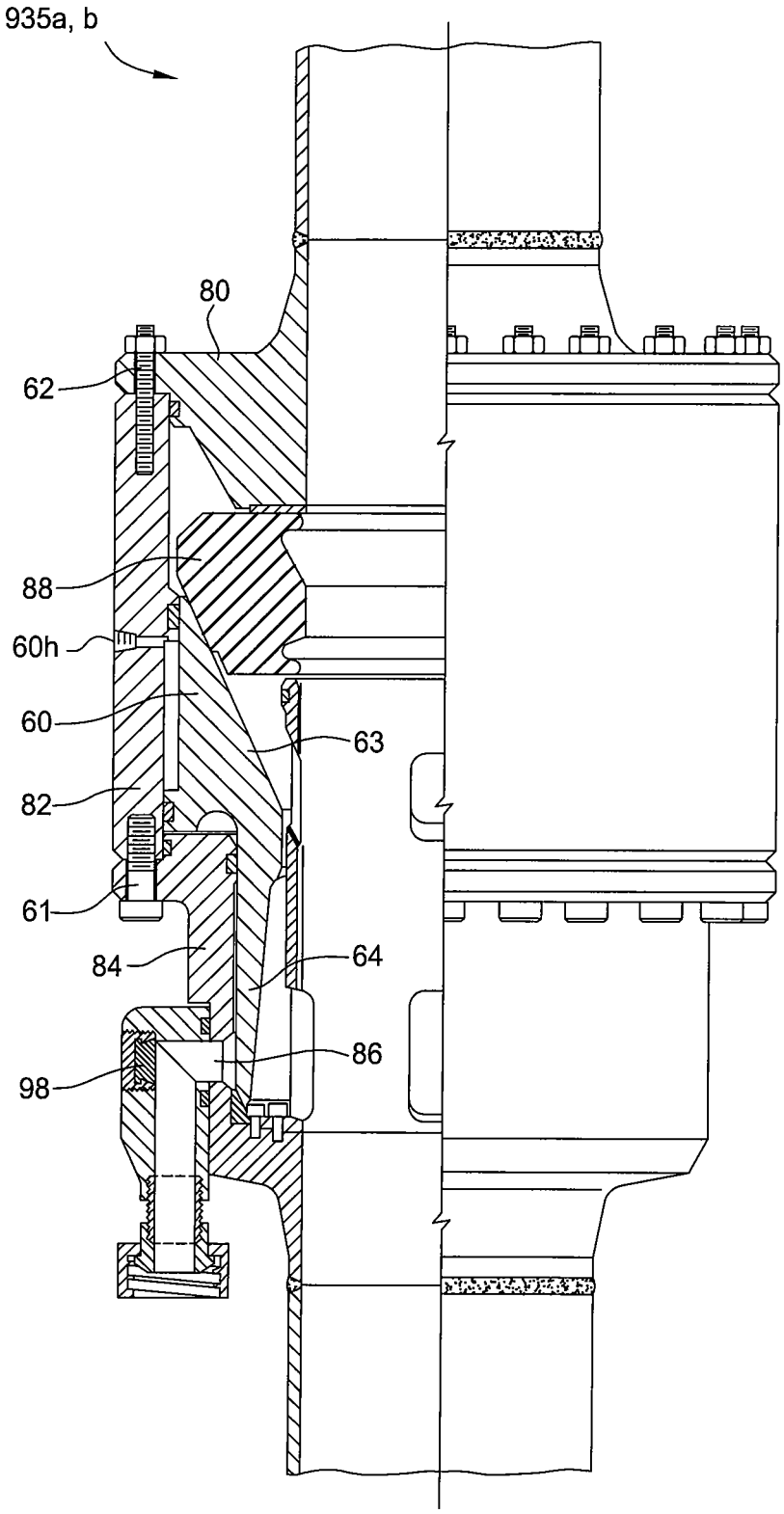
FIG. 9C is a partial cross-section of the gas handler of FIG. 9A.

FIG. 9C is a partial cross-section of the gas handler 935*a, b*. The gas handler 935*a, b* includes a cylindrical housing or outer body 82 with a lower body 84 and an upper head 80 connected to the outer body 82 by means of bolts 61 and 62. Disposed within the housing 82 is an annular packing unit 88 and a piston 60 having a conical bowl shape 63 for urging the annular packing unit 88 radially inwardly upon the upward movement of piston 60. The lower wall 64 of piston 60 covers an outlet passage 86 in the lower body 84 when the piston 60 is in the lower position. When the piston moves upwardly to force the packing element 88 inwardly about a drill pipe extending through the bore of the gas handler 935*a, b*, the lower end 64 of the piston 60 moves upwardly and opens the outlet passage 86. Actuation of the gas handler 935*a, b* causes the piston 60 to move upwardly thereby causing the packing element 88 to move radially inwardly to seal about a drill pipe 330 through its vertical flow path. As the piston 60 moves up, the outlet 86 is uncovered by the lower portion or wall 64 of the piston 60. The piston 60 is actuated upwardly by hydraulic fluid injected into a first port (not shown) in fluid communication with an underside of the piston and actuated downwardly by hydraulic fluid injected into a second port 60*h*.

Figure 10:
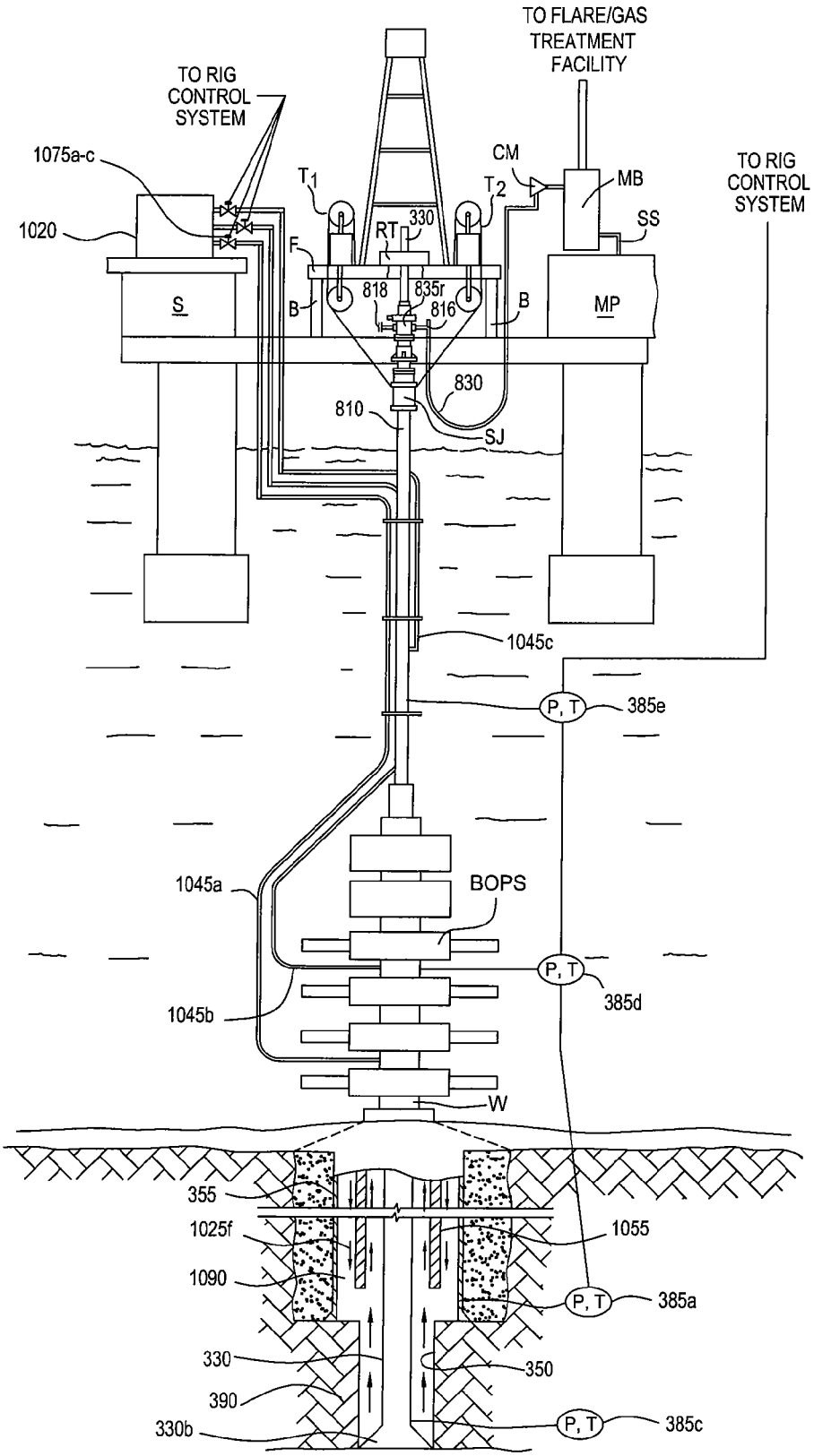
FIG. 10 illustrates an offshore drilling system, according to another embodiment of the present invention.

FIG. 10 illustrates an offshore drilling system 1000, according to another embodiment of the present invention. Alternatively, the drilling system 1000 may be deployed for land-based operations. A first casing string 355 and wellhead 315 have been drilled and set in the wellbore 350. As shown, the first casing string 355 is cemented in the wellbore 350. Alternatively, the first casing string 355 may not be cemented in the wellbore 350. A second or tieback casing string 1055 has also been hung from the well head. As shown, neither the first casing string 355 nor the tieback casing string 1055 includes the DDV 360. Alternatively, the tieback casing string 1055 may include the DDV 360. In addition to the annulus 390, an annulus 1090 is formed between the tieback string 1055 and the first casing string 355. A first injection line 1045*a* is in fluid communication with the tieback annulus 1090 and extends from the wellhead, along the riser, to a pump, compressor, or other fluid source 1020 located on the floating vessel 805. A second injection line 1045*b* in fluid communication with the wellhead and a third injection line 1045*c* in fluid communication with an annulus formed between the drill string 330 and the riser 810 also extend to the fluid source 1020. A variable choke valve 1075*a-c* may be provided in each of the injection lines 1045*a-c*. The variable choke valves are in communication with the RCS.

In operation, the drilling fluid 325*d* or the refrigerated drilling fluid 525*d*, is injected through the drill string 330 and exits from the drill bit 330*b*. As the returns 325*r* or 525*r* travel through the annulus 390, a flow rate of fluid, such as a gas, determined by the RCS, is injected through the annulus 1090. The gas mixes with the returns 325*r*, 525*r* at a junction between annulus 390 and 1090, thereby lowering the density of the returns/gas mixture 1025*m* as compared to the density of the returns. The resulting lighter mixture lowers the annulus pressure that would otherwise be exerted by the column of drilling fluid. Thus by adjusting the injection rate, the annulus pressure can be controlled. Further, the gas may be choked (i.e., through valves 1075*a-c*) so that the gas 1025*f* is cooled upon expansion through the choke and provides temperature control over the returns as well.

The gas may be nitrogen, natural gas, or any of the other refrigerants, discussed above. Alternatively, the injection fluid may be any of the coolants 325*c* discussed for the drilling system 300 or a foam. In this alternative, the coolants would be refrigerated and would be used for temperature control rather than pressure control. Alternatively, microbeads may be injected. In addition, a different fluid may be provided in each of the lines.

The mixture 1025*m* returns to the floating vessel 805 via the riser. The mixture 1025*m* is diverted to the conduit 830 via the RCD 835*r* and transported to the choke manifold CM and the separator MB. PT sensors 385 *a, c-e* are placed proximate each injection point in communication with the RCS for monitoring of the injection process. Alternatively, the dual drill string 530 may be used instead of the drill string 330 to provide an injection point near the drill bit 530*b* Alternatively, or in addition to, the injection lines 1045*a-c*, one or more injection lines may extend into the wellbore 350 as parasite strings disposed along an outer surface of the casing string 355.

Alternatively, any of the disassociation fluids discussed above for the drilling system 600 may be injected to provide controlled subsea and/or subsurface disassociation of the hydrates. Alternatively, the drilling system 1000 may be implemented for drilling heavy crude oil and/or tar sands formations using heated injection fluids and/or additives to provide viscosity control.

Figure 11A:
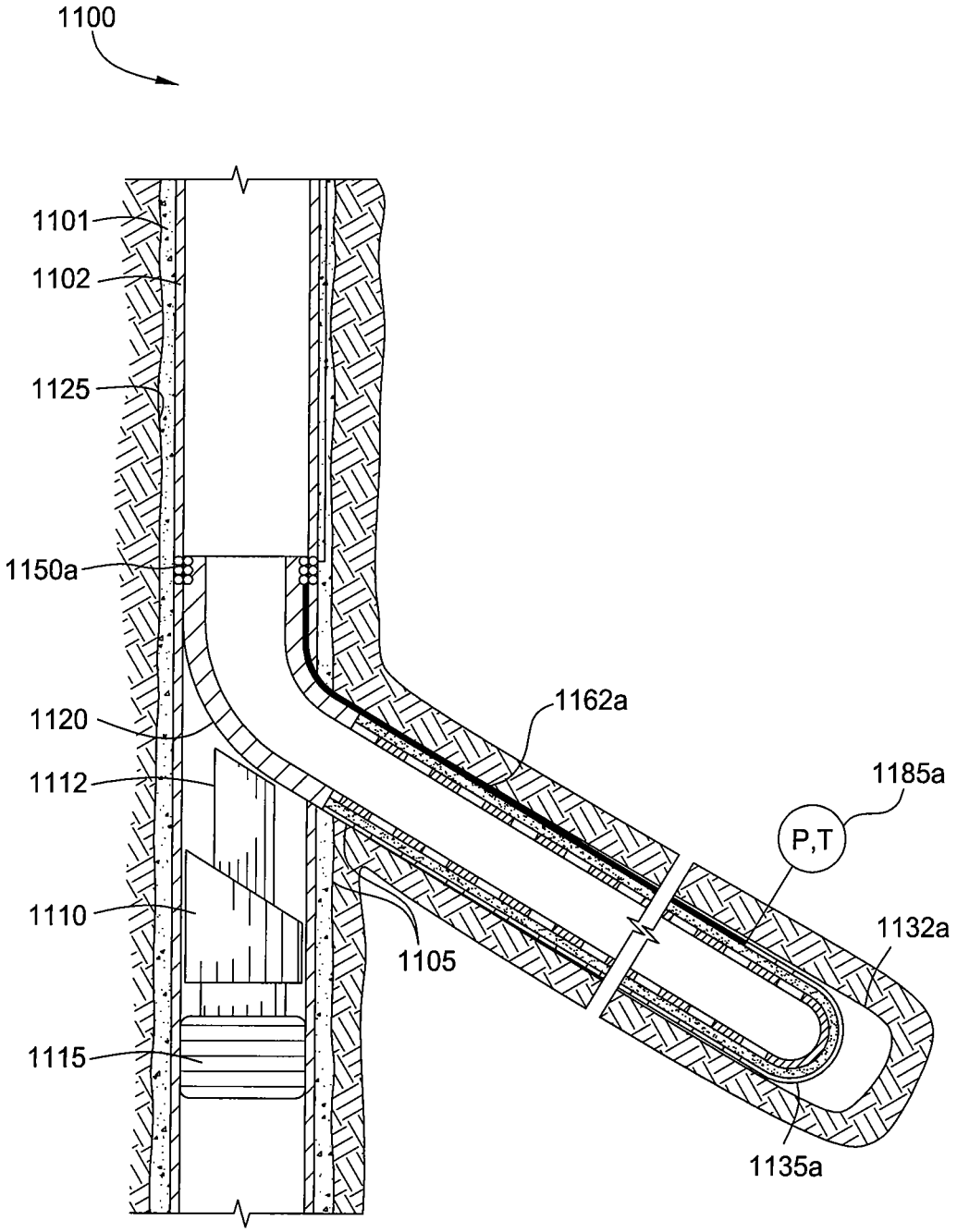

FIG. 11A-D illustrate a multi-lateral completion system 1100, according to another embodiment of the present invention. FIG. 11A illustrates a first lateral wellbore of the completion system 1100. A lateral wellbore 1132*a* has been formed off of a cased 1102 and cemented 1101 primary wellbore 1125. The primary wellbore may be drilled using any of the drilling systems 300-1000. In order to accomplish this, a whipstock (not shown), a deflector 1110, and an anchor 1115 are lowered into the primary wellbore 1100. The whipstock is properly oriented and located using conventional MWD, gyro, pipe tally, or radioactive tags. The anchor 1115 is set. A window is milled/drilled through the casing 1102 and the cement 1101, using the whipstock (not shown) as a guide, and the drilling is continued until the lateral wellbore 1132*a* formed. The lateral wellbore 1132*a* may be drilled using any of the drilling systems 300-1000.

Since expandable liner 1135*a* will be installed, the lateral wellbore 1132*a* may be under-reamed, such as with a bi-center or expandable bit, resulting in an inside diameter near that of the central wellbore 1100. The whipstock is removed and replaced by a deflector stem 1112. The deflector stem 1112 and deflector device 1110 may comprise a mating orientation feature (not shown), such as a key and keyway, for properly orientating the deflector stem into the deflector device. The anchor 1115 may include a packer or may be a separate anchor and packer. Once the deflector stem 1112 is set, an expandable liner (unexpanded) 1135*a* is lowered through the primary wellbore 1125, along the deflector stem 1112, into the lateral wellbore 1132*a*. The liner 1135*a* is then expanded against the walls of the primary wellbore 1125 and the lateral wellbore 1132*a* using an expander tool.

The expandable liner 1135*a* includes a PT sensor 1185*a* in fluid communication with a bore thereof. A line 1162*a* disposed in the expandable liner provides data communication between the PT sensor 1185*a* and part of an inductive coupling 1150*a*. The line 1162*a* may also provide power to the PT sensor 1185*a*. As discussed earlier, a first inductive coupling may be provided for data transfer and a second inductive coupling may be provided for power transfer. The other part of the inductive coupling 1150*a* is disposed within/around a wall of the casing string 1102. To facilitate optional placement of the lateral wellbore 1132*a*, parts of inductive couplings may be spaced along the casing 1125 at a selected interval. A line 1162*c* provides data communication between the inductive coupling 1150*a* and the RCS. The line 1162*c* may also provide power to the inductive coupling 1150*a*.

FIG. 11C illustrates a sectional view of the expandable liner of FIG. 11A in an unexpanded state. FIG. 11B illustrates a sectional view of a portion of FIG. 11C, in an expanded state. The expandable liner 1135*a* is constructed from three layers. These define a slotted structural base pipe 1140*a*, a layer of filter media 1140*b*, and an outer protecting sheath, or "shroud" 1140*c*. Both the base pipe 1140*a* and the outer shroud 1140*c* are configured to permit hydrocarbons to flow through perforations formed therein. The filter material 1140*b* is held between the base pipe 1140*a* and the outer shroud 1140*c*, and serves to filter sand and other particulates from entering the liner 1135*a* and a production tubular. A portion 1120 of the expandable liner 1135*a* proximate to a junction 1105 between the primary wellbore 1125 and the lateral wellbore 1132*a* may be a single layer (perforated or solid) material.

A recess 1145*r* is formed in the outer layer 1140*c* of the expandable liner 1135. A conduit 1145*c* is disposed in the recess 1145*r* and may include arcuate inner and outer walls and side walls. The outer arcuate wall may include an opening. One or more instrumentation lines 1162 are disposed within the conduit 1145*c*. The instrumentation lines may be housed in metal tubulars 1160. An optional filler material 1164 may also encase the instrumentation lines 1162 in order to maintain them within the conduit. The filler material 1164 may be an extrudable polymer or a hardenable foam material.

Figure 11D:
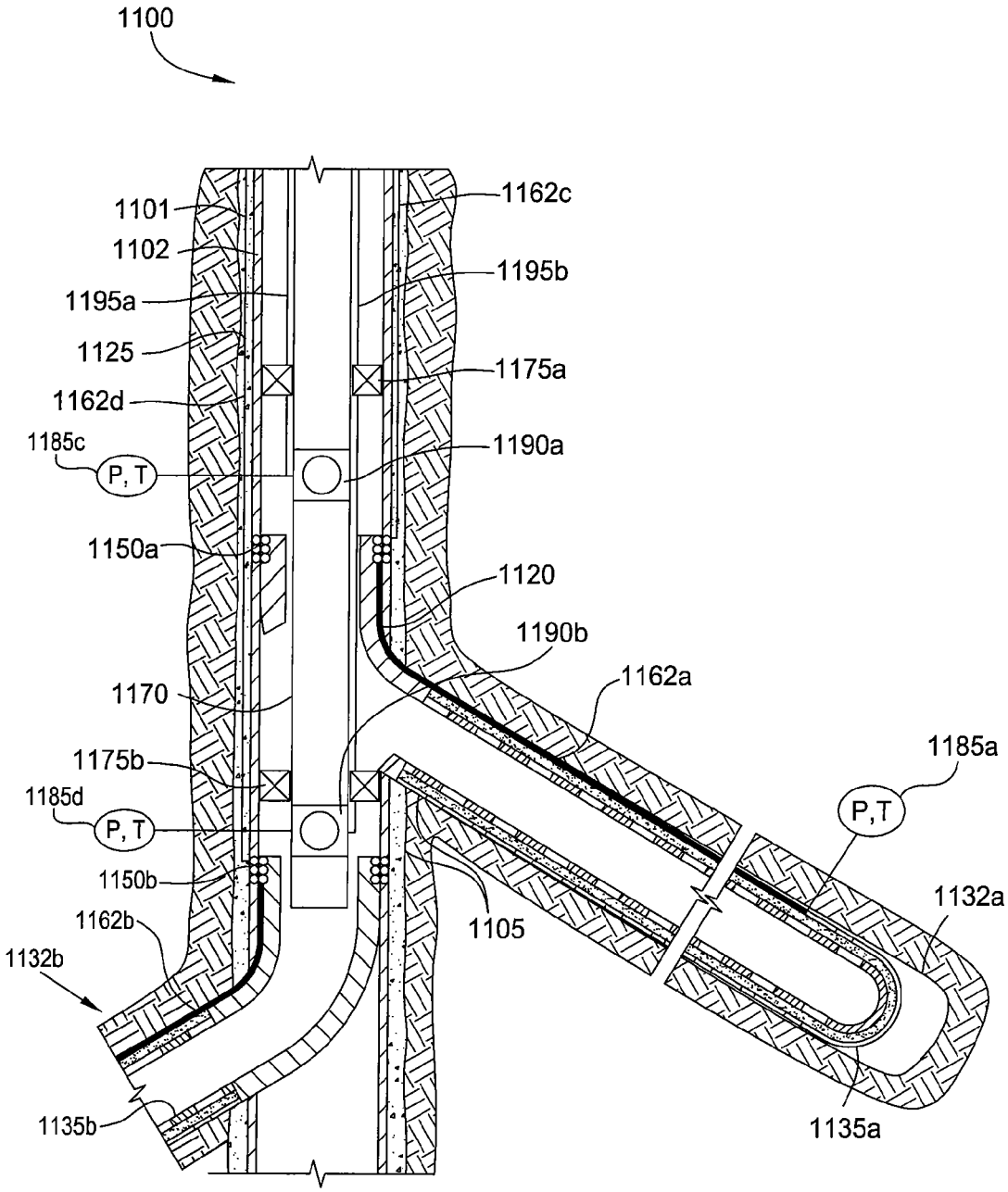

FIG. 11D illustrates the completion system 1100 having a second lateral wellbore 1132*b* formed therein. An opening in the expandable liner 1135*a* has been milled/drilled to restore access to the primary wellbore 1125. A second lateral wellbore 1132*b* has been formed from the primary wellbore 1125 in a similar manner to the first lateral wellbore 1132*a*. A string of production tubing 1170 has been lowered to through the opening formed in the first liner 1135*a* and to a second liner 1135*b*. Packers 1175*a, b* seal against an outer surface of the production tubing 1170 and an inner surface of the casing 1102, thereby isolating each lateral wellbore 1132*a, b* from the other and both lateral wellbores 1132*a, b* from a portion of an annulus between the casing 1102 and the production tubing 1170 in communication with a surface of the primary wellbore 1125. Production valves 1190*a, b*, such as sliding sleeve valves, are disposed in the production tubing 1170 and provide selective fluid communication between the production tubing 1170 and a respective lateral wellbore 1132*a, b* (the production tubing may be capped and/or may extend to other lateral wellbores). The production valves 1190*a, b* may be variable. Also disposed in the production tubing 1170 in proximity to the production valves 1190*a, b* are respective PT sensors 1185*c, d*. Control lines 1195*a, b* are disposed along the production tubing 1170 to provide data communication between the RCS and the sensors 1185 *c, d* and control of the valves 1190*a, b*. The packers 1175*a, b* provide for sealed passage of the control lines 1195*a, b* therethrough. Additionally, the string of production tubing 1170 may have the DDV 360 disposed therein. Alternatively, a string of production tubing may be run into each lateral wellbore 1132*a, b* and sealed therewith by a packer. Further, each of the strings of production tubing may have a DDV 360 disposed therein. The completion system 1100 may employ any number of lateral wellbores.

Figure 12:
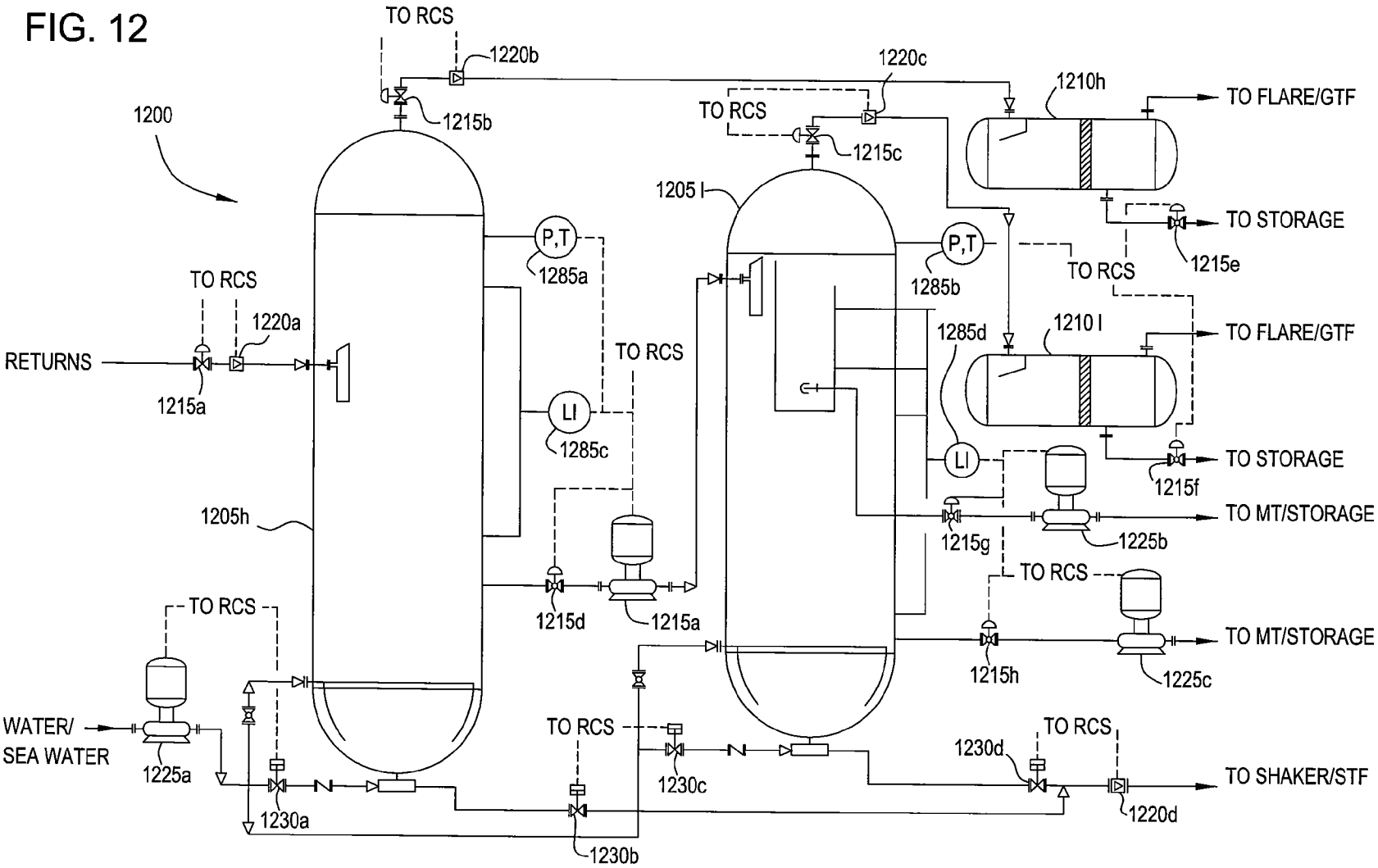
FIG. 12 is an illustration of a rig separation system, according to one embodiment of the present invention.

FIG. 12 is an illustration of a rig separation system 1200, according to one embodiment of the present invention. The rig separation system 1200 may be used with the drilling systems 300-700 and 1000. The rig separation system 1200 may include separators 1205*h, l*, gas scrubbers 1210*h, l* variable choke valves 1215*a-h*, flow meters 1220*a-d*, pumps 1225*a-c*, automatic gate valves 1230*a-d*, PT sensors 1285*a, b*, and level sensors 1285 *c, d*. Instrumentation lines provide communication between these components and the RCS. The returns 325*r*, 525*r* from the wellbore 350 enter an inlet line and pass through the variable choke valve 1215*a* and the flow meter 1220*a* into a high pressure separator. The high pressure separator is a three phase separator having a gas outlet line, a liquid outlet line, and a solids outlet line. The variable choke valve 1215*b* and the flow meter 1220*b* are disposed in the gas outlet line of the high pressure separator 1205*h*.

In one aspect, the variable choke valve 1215*a* is maintained in a fully open position and the variable choke valve 1215*b* is used to control the pressure in the high pressure separator 1205*h* and thus the back pressure on the annulus 390 of the wellbore. This may be advantageous to avoid erosion and/or disassociation of the hydrates through the variable choke valve 1215*a*.

A liquid level in the high pressure separator is maintained by variable choke valve 1215*d* and the pump 1225*a* disposed in the liquid outlet line of the high pressure separator. The liquid level in the high pressure separator may be maintained above or below the returns inlet line. It may be advantageous to maintain the liquid level above the returns inlet line because there may be a layer of solid hydrate cuttings floating on the liquid level. The hydrates may entrain rock cuttings if the return stream passes through them, thereby discouraging effective separation. Disassociation of the solid hydrates may be controlled in the high pressure separator as the solid hydrates may be trapped therein. This may be accomplished by heating the separator, by injecting a hydrates inhibitor in the separator, or by injecting heated drilling fluid in the separator. Alternatively, or in addition to, the pressure in the high pressure separator may be set at a pressure to encourage disassociation. If additional back pressure is required on the annulus, the variable choke valve 1215*a* may be used to provide a higher back pressure than the operating pressure of the high pressure separator 1205*h*.

Gas from the high pressure separator enters the high pressure scrubber where additional liquid is separated therefrom. The gas from the high pressure scrubber may then be transported to a flare or a gas treatment facility (GTF). The liquid level in the high pressure scrubber 1210*h* is maintained by the variable choke valve 1215*e* disposed in a liquid outlet line thereof. Liquid is transported through this line to a storage facility. Liquid exits the high pressure separator 1205*h* though the valve 1215*d* where it may be pumped via the pump 1225*a* into the low pressure separator 1205*l*. Whether the pump 1225*a* is required depends on the operating pressure of the high pressure separator.

The low pressure separator 1205*l* is a four phase separator having a gas outlet, a light liquid outlet, a heavy liquid outlet, and a solids outlet. The light liquid exits the low pressure separator into an outlet line having a variable choke valve 1215*g* disposed therein which controls the level of the light liquid in the low pressure separator. Depending on the operating pressure of the low pressure separator, a pump 1225*b* may be disposed in the outlet line. The light liquid may then travel to a drilling fluid reservoir or a storage facility, depending on whether it is being used as the drilling fluid.

The heavy liquid exits the low pressure separator into an outlet line having a variable choke valve 1215*h* disposed therein which controls the level of the heavy liquid in the low pressure separator. Depending on the operating pressure of the low pressure separator, a pump 1225*c* may be disposed in the outlet line. The heavy liquid may then travel to a drilling fluid reservoir or a storage facility, depending on whether it is being used as the drilling fluid. Gas from the low pressure separator 1205*l* enters the low pressure scrubber 1210*l* where additional liquid is separated therefrom. The gas from the low pressure scrubber 1210*l* may then be transported to a flare or a gas treatment facility (GTF). The liquid level in the low pressure scrubber 1210*l* is maintained by the variable choke valve 1215*f* disposed in a liquid outlet line thereof. Liquid is transported through this line to a storage facility.

Solids (rock cuttings) exit each of the high 1205*h* and low 1205*l* pressure separators through respective outlets into a slurry line. The pump 1225*a* injects water or seawater through the slurry line. The water/seawater is diverted from the slurry line through a set of nozzles that continually wash a portion of each separator to prevent clogging of the solids outlet. The solids are washed through each outlet into the slurry line and are transported to a shaker or solids treatment facility (STF) for disposal. Automatic gate valves 1230*a-d* allow portions of the slurry line to be closed and maintained should the line become plugged.

The specific separation system 1200 configuration may depend upon what fluid is used for the drilling fluid 325*d*, 525*d*, whether any coolants or injection fluids are added to the returns (i.e. drilling systems 400 and 1000), and whether any producing formations are drilled through to arrive at the hydrates formation. For example, if the drilling fluid is oil or oil-based, then oil will be the light liquid from the low pressure separator and water will be the heavy fluid from the separator. The oil would be recirculated to the drilling fluid reservoir MT and the water would be stored for proper disposal or other uses. If the drilling fluid was water or water based, then the low pressure separator may not be required since the liquid line from the high pressure separator may be routed directly to the drilling fluid reservoir MT. If the drilling fluid were a mix of water and propylene glycol, then the water would be the light liquid and the glycol would be the heavy liquid and both liquids could be stored and mixed again in the drilling reservoir and/or the liquid line from the high pressure separator could be routed directly to the drilling fluid reservoir and additional glycol added to compensate dilution from the disassociated hydrates. Additionally, if more than two liquid phases are present in the returns, additional separators may be required. If the drilling fluid is a foam or gas, then the low pressure separator may not be required.

In another embodiment, a method uses the systems 300-1200 or a combination of some of the components from any of the systems 300-1200. In this method, a disassociation profile of the hydrates formation to be drilled is entered into the RCS. This profile may be constructed from empirical data and/or from analysis of samples collected from the hydrates formation. From this profile, a simulation may be run to aid in selection of the optimal system 300-1200 (or combination thereof). Another consideration in selection of the system is response time for pressure and/or temperature changes. For example, if a system is selected which allows only temperature control by refrigeration of the drilling fluid, then the response time will be relatively slow because the drilling fluid will have to circulate through the drill string and into the annulus (may not apply to the dual drill string embodiment(s)). In comparison, if coolant is circulated through the riser string or injected into the wellbore annulus and/or riser, then the response time is considerably more expedient. Further, control of discrete points/regions along the returns path, for example, the wellbore annulus and the riser may be desirable.

Also, a mode of operation of the system 300-1200 may be selected, for example, whether to allow subsea and/or subsurface disassociation of the hydrates cuttings. Drilling into the hydrates formation commences. During drilling, operation is monitored by the RCS and/or rig personnel using the PT sensors, flow meters, and/or operating conditions of the surface equipment to ensure that the wellbore is under control.

If the mode of preventing subsurface and/or subsea disassociation is selected and is not in fact occurring, annulus pressure and/or temperature may be adjusted to achieve this goal. For example, injection parameters of the riser coolant, refrigerated drilling fluid, operation of the subsea pump, back pressure on the annulus, operation of the subsea separator, operation of the vacuum pump, and/or injection of fluids into the annulus and/or riser may be adjusted to rectify the situation.

If the mode of allowing subsurface and/or subsea disassociation is selected, then the disassociation rate may be controlled by adjusting annulus pressure and/or temperature. This may be effected in a similar manner discussed above for the preventative mode. Further, the pressure and/or temperature may be adjusted for only portions of the returns path. For example, the annulus conditions may be acceptable but the disassociation in the riser may be occurring too rapidly. Then, the injection parameters of the riser coolant may be varied while maintaining the wellbore annulus conditions as they are. In this manner, disassociation may be controlled at discrete points along the returns path. Conversely, if the disassociation is lagging or not occurring in the wellbore, then heated/disassociation fluid may be injected at one or more injection points along the annulus to facilitate disassociation. To counter any additional effects, for example, an associated increase of disassociation in the riser, the riser coolant parameters may accordingly be adjusted. It may even be advantageous to heat some portions of the returns path while cooling others. Similar scenarios may be envisioned for pressure control as well. Further, disassociation may be allowed for some points along the return path and not allowed for other points.

Further, when using systems with multiple return paths, it may be desirable to allocate returns among the various return paths depending on the disassociation rates. One advantage to such an allocation is to divide separation duties between the subsea separator and the rig separator(s). Another advantage is that disassociation rates may be varied along the different return paths.

Further, drilling may commence in the preventative mode and then be transitioned into the disassociation mode upon successful control of the preventative mode. In this manner, the disassociation profile may be adjusted to reflect actual conditions. Transition between the modes may be desired to accommodate changing drilling conditions.

Alternatively, any of the drilling systems 300-1000 may be used for drilling to other formations besides hydrate formations, such as crude oil and/or natural gas formations or coal bed methane formations.

While the foregoing is directed to embodiments of the present invention, other and further embodiments of the invention may be devised without departing from the basic scope thereof, and the scope thereof is determined by the claims that follow.

What is claimed is:

1. A method for drilling a wellbore into a gas hydrates formation, comprising:

drilling the wellbore into the gas hydrates formation by:

injecting drilling fluid through a drill string disposed in the wellbore and rotating a drill bit disposed on an end of the drill string; and returning gas hydrates cuttings and the drilling fluid (returns) to a surface of the wellbore and/or a drilling rig; and while drilling the wellbore:

separately injecting a coolant along an annulus of a concentric tubular string conducting the returns to control a temperature of the gas hydrates cuttings, thereby preventing or discouraging disassociation of the gas hydrates cuttings; and communicating pressure and temperature from sensors disposed along the concentric tubular string to a rig control system.

2. The method of claim 1, wherein:

the concentric tubular string is a concentric riser, the annulus is an outer annulus of the concentric riser, the concentric riser has a bore and extends from the drilling rig to a floor of a sea, the outer annulus and the bore are isolated from one another, the drill string is disposed through the riser bore, the gas hydrates cuttings are returned to the drilling rig via an inner annulus formed between the riser bore and the drill string.

3. The method of claim 2, wherein a layer of insulation is disposed around an outer surface of the riser.

4. The method of claim 1, wherein:

at least a portion of an outer surface of the drill string is exposed to a sea, the returns are diverted into a multiphase pump at a floor of the sea, and the returns are pumped to the drilling rig via a discharge line.

5. The method of claim 4, wherein:

the concentric tubular string is a discharge line, and the annulus is an outer annulus of the discharge line.

6. The method of claim 4, wherein:

the multiphase pump has a pressure sensor and a temperature sensor in fluid communication with an inlet of the pump and a pressure sensor and a temperature sensor in fluid communication with an outlet of the pump, and the pump sensors are in communication with the rig control system.

7. The method of claim 1, wherein a pressure of the returns is controlled to prevent or discourage disassociation of the gas hydrates cuttings.

8. A method for drilling a wellbore into a gas hydrates formation, comprising:

drilling the wellbore into the gas hydrates formation by:

injecting drilling fluid through a drill string disposed in the wellbore and rotating a drill bit disposed on an end of the drill string; and returning gas hydrates cuttings and the drilling fluid (returns) to a surface of the wellbore and/or a drilling rig; and while drilling the wellbore, separately injecting a coolant along a tubular string conducting the returns to control a temperature of the gas hydrates cuttings, thereby preventing or discouraging disassociation of the gas hydrates cuttings, wherein:

the tubular string is a concentric riser having a bore and an outer annulus and extending from the drilling rig to a floor of a sea, the coolant is injected into the outer annulus, the outer annulus and the bore are isolated from one another, the drill string is disposed through the riser bore, the gas hydrates cuttings are returned to the drilling rig via an inner annulus formed between the riser and the drill string, pressure sensors and temperature sensors are disposed along the riser, and the pressure and temperature sensors in communication with a rig control system and the bore of the riser string.

9. A method for drilling a wellbore into a gas hydrates formation, comprising:

drilling the wellbore into the gas hydrates formation by:

injecting drilling fluid through a drill string disposed in the wellbore and rotating a drill bit disposed on an end of the drill string; and returning gas hydrates cuttings and the drilling fluid (returns) to a surface of the wellbore and/or a drilling rig; and while drilling the wellbore, separately mixing a coolant with the returns to control a temperature of the gas hydrates cuttings, thereby preventing or discouraging disassociation of the gas hydrates cuttings.

10. The method of claim 9, wherein:

at least a portion of an outer surface of the drill string is exposed to a sea, the returns are diverted into a multiphase pump at a floor of the sea, and the returns are pumped to the drilling rig via a discharge line.

11. The method of claim 10, wherein:

the returns are diverted at a wellhead, and the coolant is mixed with the returns at the wellhead.

12. The method of claim 10, wherein:

the multiphase pump has a pressure sensor and a temperature sensor in fluid communication with an inlet of the pump and a pressure sensor and a temperature sensor in fluid communication with an outlet of the pump, and the sensors are in communication with a rig control system.

13. The method of claim 9, wherein:

the returns are transported through a first annulus formed between the drill string and a tie-back casing;

the coolant is injected into a second annulus formed between the tie-back casing and a second casing, and the coolant mixes with the returns at a bottom of the second casing.

14. The method of claim 13, wherein the drilling fluid has a first density and the coolant has a second density that is substantially less than the first density.

15. The method of claim 13, wherein the coolant is a gas.

16. The method of claim 13, wherein:

a wellhead is attached to the second casing, and the method further comprises injecting a second fluid in the wellhead, and the second fluid mixes with the returns.

17. The method of claim 16, wherein:

the returns are transported to the drilling rig via a riser, and the method further comprises injecting a third fluid into the riser, and the third fluid mixes with the returns.

18. The method of claim 9, wherein a pressure of the returns is controlled to prevent or discourage disassociation of the gas hydrates cuttings.

19. A method for drilling a wellbore into a gas hydrates formation, comprising:

drilling the wellbore into the gas hydrates formation by injecting drilling fluid through a drill string disposed in the wellbore and rotating a drill bit disposed on an end of the drill string;

returning gas hydrates cuttings and the drilling fluid (returns) to a floor of a sea;

separating the gas hydrates cuttings from a rest of the returns at the seafloor;

disassociating the gas hydrates cuttings into a gas and $H_2O$; and transporting the disassociated gas to a drilling rig.

20. The method of claim 19, wherein the gas hydrates cuttings are disassociated in a subsea separator.

21. The method of claim 20, further comprising:

diverting the returns into the subsea separator, wherein the disassociated gas is transported to the drilling rig via a gas return line.

22. The method of claim 21, further comprising pumping the rest of the returns from the separator into a riser extending from the drilling rig to the seafloor.

23. The method of claim 21, wherein the disassociated gas is transported to the drilling rig by using a vacuum pump.

24. The method of claim 19, wherein the gas hydrates cuttings are disassociated in a riser extending from the drilling rig to the seafloor.

25. The method of claim 24, further comprising pumping the rest of the returns from the riser to the drilling rig via a return line.

26. The method of claim 24, wherein:

a blow out preventer (BOP) is disposed along the riser, and the BOP is selectively actuatable to engage an outer surface of the drill string and divert the gas to an outlet line extending to the drilling rig.

27. The method of claim 19, further comprising:

encouraging the disassociation by mixing a hydrates inhibitor or heated fluid with the gas hydrates cuttings.

28. The method of claim 19, further comprising:

encouraging the disassociation by controlling pressure of the gas hydrates cuttings.

29. A method for drilling a wellbore into a gas hydrates formation, comprising:

drilling the wellbore into the gas hydrates formation by injecting drilling fluid through a drill string disposed in the wellbore and rotating a drill bit disposed on an end of the drill string;

returning gas hydrates cuttings and the drilling fluid (returns) to a surface of the wellbore and/or a drilling rig; and injecting a coolant along a tubular string conducting the returns to control a temperature of the gas hydrates cuttings, thereby preventing or controlling disassociation of the gas hydrates cuttings, wherein:

at least a portion of an outer surface of the drill string is exposed to a sea, the returns are diverted into a multiphase pump at a floor of the sea, the returns are pumped to the drilling rig via a discharge line, the discharge line is concentric, and the coolant is injected along an outer annulus of the discharge line.

30. A method for drilling a wellbore into a gas hydrates formation, comprising:

drilling the wellbore into the gas hydrates formation by injecting drilling fluid through a drill string disposed in the wellbore and rotating a drill bit disposed on an end of the drill string;

returning gas hydrates cuttings and the drilling fluid (returns) to a surface of the wellbore and/or a drilling rig; and mixing a coolant with the returns to control a temperature of the gas hydrates cuttings, thereby preventing or controlling disassociation of the gas hydrates cuttings, wherein:

at least a portion of an outer surface of the drill string is exposed to a sea, the returns are diverted into a multiphase pump at a floor of the sea, the returns are pumped to the drilling rig via a discharge line, the returns are diverted at a wellhead, and the coolant is mixed with the returns at the wellhead.

31. A method for drilling a wellbore into a gas hydrates formation, comprising:

drilling the wellbore into the gas hydrates formation by injecting drilling fluid through a drill string disposed in the wellbore and rotating a drill bit disposed on an end of the drill string;

returning gas hydrates cuttings and the drilling fluid (returns) to a surface of the wellbore and/or a drilling rig; and mixing a coolant with the returns to control a temperature of the gas hydrates cuttings, thereby preventing or controlling disassociation of the gas hydrates cuttings, wherein:

at least a portion of an outer surface of the drill string is exposed to a sea, the returns are diverted into a multiphase pump at a floor of the sea, the returns are pumped to the drilling rig via a discharge line the multiphase pump has a pressure sensor and a temperature sensor in fluid communication with an inlet of the pump and a pressure sensor and a temperature sensor in fluid communication with an outlet of the pump, and the sensors are in communication with a rig control system.

32. A method for drilling a wellbore into a gas hydrates formation, comprising:

drilling the wellbore into the gas hydrates formation by injecting drilling fluid through a drill string disposed in the wellbore and rotating a drill bit disposed on an end of the drill string;

returning gas hydrates cuttings and the drilling fluid (returns) to a surface of the wellbore and/or a drilling rig; and mixing a coolant with the returns to control a temperature of the gas hydrates cuttings, thereby preventing or controlling disassociation of the gas hydrates cuttings, wherein:

the returns are transported through a first annulus formed between the drill string and a tie-back casing;

the coolant is injected into a second annulus formed between the tie-back casing and a second casing, and the coolant mixes with the returns at a bottom of the second casing.

33. A method for drilling a wellbore into a gas hydrates formation, comprising:

drilling the wellbore into the gas hydrates formation by injecting drilling fluid through a drill string disposed in the wellbore and rotating a drill bit disposed on an end of the drill string;

returning gas hydrates cuttings and the drilling fluid (returns) to a floor of a sea;

separating the gas hydrates cuttings from a rest of the returns at the seafloor; and disassociating the gas hydrates cuttings into a gas and $H_2O$ in a riser extending from a drilling rig to the seafloor, wherein:

a blow out preventer (BOP) is disposed along the riser, and the BOP selectively actuatable to engage an outer surface of the drill string and divert the gas to an outlet line extending to the drilling rig.

34. A method for drilling a wellbore into a gas hydrates formation, comprising:

drilling the wellbore into the gas hydrates formation by injecting drilling fluid through a drill string disposed in the wellbore and rotating a drill bit disposed on an end of the drill string;

returning gas hydrates cuttings and the drilling fluid (returns) to a floor of a sea;

separating the gas hydrates cuttings from a rest of the returns at the seafloor;

disassociating the gas hydrates cuttings into a gas and $H_2O$; and encouraging the disassociation by mixing a hydrates inhibitor or heated fluid with the gas hydrates cuttings.

35. A method for drilling a wellbore into a gas hydrates formation, comprising:

drilling the wellbore into the gas hydrates formation by injecting drilling fluid through a drill string disposed in the wellbore and rotating a drill bit disposed on an end of the drill string;

returning gas hydrates cuttings and the drilling fluid (returns) to a floor of a sea;

separating the gas hydrates cuttings from a rest of the returns at the seafloor;

disassociating the gas hydrates cuttings into a gas and $H_2O$; and encouraging the disassociation by controlling pressure of the gas hydrates cuttings.

36. A method for drilling a wellbore into a gas hydrates formation, comprising:

drilling the wellbore into the gas hydrates formation by:

injecting drilling fluid through a drill string disposed in the wellbore and rotating a drill bit disposed on an end of the drill string; and returning gas hydrates cuttings and the drilling fluid (returns) to a surface of the wellbore and/or a drilling rig; and while drilling the wellbore, separately injecting a coolant along a tubular string conducting the returns to control a temperature of the gas hydrates cuttings, thereby preventing or discouraging disassociation of the gas hydrates cuttings, wherein:

at least a portion of an outer surface of the drill string is exposed to a sea, the returns are diverted into a multiphase pump at a floor of the sea, and the returns are pumped to the drilling rig via a discharge line.

* * * * *